US009341993B2

(12) United States Patent
Nakaegawa

(10) Patent No.: US 9,341,993 B2
(45) Date of Patent: May 17, 2016

(54) IMAGE FORMING APPARATUS

(71) Applicant: CANON KABUSHIKI KAISHA, Tokyo (JP)

(72) Inventor: Tohru Nakaegawa, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/574,810

(22) Filed: Dec. 18, 2014

(65) Prior Publication Data

US 2015/0185666 A1 Jul. 2, 2015

(30) Foreign Application Priority Data

Dec. 27, 2013 (JP) ..... 2013-270868

(51) Int. Cl.
*G03G 15/16* (2006.01)

(52) U.S. Cl.
CPC ..... *G03G 15/1665* (2013.01); *G03G 15/1605* (2013.01); *G03G 15/1675* (2013.01)

(58) Field of Classification Search
CPC ..... G03G 15/1665; G03G 15/1675; G03G 15/1605
See application file for complete search history.

(56) References Cited

U.S. PATENT DOCUMENTS 6,434,344 B1 * 8/2002 Yoshida ..... G03G 15/1675 399/44
6,449,444 B1 * 9/2002 Tanaka ..... G03G 15/1675 399/313
8,634,737 B2 1/2014 Nakaegawa
2006/0127115 A1 * 6/2006 Iwasaki ..... G03G 15/1675 399/66
2008/0131156 A1 * 6/2008 Brockman ..... G03G 15/1675 399/66
2010/0046969 A1 * 2/2010 Kim ..... G03G 15/1605 399/43
2013/0287421 A1 10/2013 Makino
2015/0016833 A1 1/2015 Nakaegawa et al.
2015/0023679 A1 1/2015 Nakaegawa et al.
2015/0023680 A1 1/2015 Nakaegawa et al.

FOREIGN PATENT DOCUMENTS

JP 2007-271798 10/2007
JP 2012-098709 A 5/2012
JP 2012-098710 A 5/2012
JP 2013-213995 A 10/2013

* cited by examiner

*Primary Examiner* — Ryan Walsh
(74) *Attorney, Agent, or Firm* — Fitzpatrick, Cella, Harper & Scinto

(57) ABSTRACT

An image forming apparatus includes: an image bearing member; an electrostatic image forming unit; a developing unit; an intermediary transfer member; a rotatable secondary transfer member; a constant voltage element; a voltage source; and a controller. The apparatus is operable in a lowering mode in which a secondary transfer electric field in a trailing end region of a recording material passing through a secondary transfer position with respect to a recording material feeding direction is made lower than the secondary transfer electric field in a region from a leading end to the trailing end region of the recording material. The controller sets a toner image distance so as to be longer than the toner image distance when the operation in the lowering mode is not performed to prevent a toner image from being primary-transferred in a period in which the secondary transfer electric field is lowered.

12 Claims, 12 Drawing Sheets

(a)

(b)

IMAGE FORMING APPARATUS

FIELD OF THE INVENTION AND RELATED ART

The present invention relates to an image forming apparatus, of an electrophotographic type, such as a copying machine or a printer.

In the image forming apparatus of the electrophotographic type, in order to meet various recording materials, an intermediary transfer type in which a toner image is primary-transferred from a photosensitive member such as a photosensitive drum onto an intermediary transfer member such as an intermediary transfer belt, and then is secondary-transferred from the intermediary transfer member onto the recording material to form an image has been known. In this type, a primary transfer roller for primary-transferring the toner image from the photosensitive member onto the intermediary transfer member is provided, and a voltage source exclusively for primary transfer is connected to the primary transfer roller. Further, a secondary transfer roller for secondary-transferring the toner image from the intermediary transfer member onto the recording material is provided, and a voltage source exclusively for secondary transfer is connected to the secondary transfer roller.

However, when the voltage source exclusively for the primary transfer and the voltage source exclusively for the secondary transfer are provided individually as described above, there is a liability that an increase in cost and upsizing of an intermediary transfer unit are caused. Therefore, in Japanese Laid-Open Patent Application (JP-A) 2012-98709 and JP-A 2012-98710, a technique in which the primary transfer from the photosensitive member onto the intermediary transfer member is carried out by applying a voltage to the secondary transfer roller in order to realize not only a cost reduction but also downsizing of the intermediary transfer unit by omitting the voltage source for the primary transfer has been proposed.

In JP-A 2012-98709 and JP-A 2012-98710, a constitution in which an electrostatic image forming means for forming an electrostatic image for forming a toner image on the photosensitive member, an intermediary transfer member for transferring the formed toner image at a primary transfer portion, and a transfer member for transferring the toner image from the intermediary transfer member onto a recording material at a secondary portion and provided. The image forming apparatus having this constitution includes a Zener diode connected between the intermediary transfer member and the ground, a control means for controlling an electrostatic image forming condition by the electrostatic image forming means depending on a change in voltage to be applied to the transfer member by a voltage source, and the voltage source for applying the voltage to the transfer member. As a result, by applying a transfer voltage from the voltage source to the transfer member, a secondary transfer electric field for transferring the toner image from the intermediary transfer member onto the recording material at the secondary transfer portion and a primary transfer electric field for transferring the toner image from the photosensitive member onto the intermediary transfer member at the primary transfer portion (hereinafter, this system is referred to as a "primary-transfer-high-voltage-less-system").

On the other hand, in the image forming apparatus in which the voltage source exclusively for the primary transfer is connected to the primary transfer roller and the voltage source exclusively for the secondary transfer is connected to the secondary transfer roller, in some cases, various image defects generate at the secondary transfer portion. For example, in the case where a thick recording material (thick paper) is passed through the secondary transfer portion, when a gap (spacing) is formed between the intermediary transfer belt and a trailing end portion of the recording material, the first defects due to scattering of the toner image at the recording material trailing end portion and abnormal electric discharge can generate. Therefore, in JP-A 2007-271798, a constitution in which a secondary transfer bias in a region correspondingly to a recording material trailing end region is made lower than a secondary transfer bias in a region from a recording material leading end to the recording material trailing end region only in the case of a species of paper (recording material) for which there is a liability of the generation of the image defects, thereby to prevent the scattering and the like has been proposed (hereinafter, this bias is referred to as a "trailing end weak bias").

In the image forming apparatus in which the dedicated voltage sources are connected to the primary transfer roller and the secondary transfer roller, respectively, the primary transfer portion and the secondary transfer portion are independently constituted, and therefore even when the secondary transfer bias is lowered only in the recording material trailing end region, the image formation at the primary transfer portion is not adversely affected. However, in the "primary-transfer-high-voltage-less-system", the image formation at the primary transfer portion and the secondary transfer portion is effected only by a high voltage (bias) at the secondary transfer portion, and therefore there is possibility that the following problem generates. That is, when the transfer bias is lowered in the recording material trailing end region in order to realize the trailing end weak bias, there is a liability that a current at the primary transfer portion becomes insufficient and thus the image formation at the primary transfer portion is not optimally carried out.

SUMMARY OF THE INVENTION

According to an aspect of the present invention, there is provided an image forming apparatus comprising: an image bearing member; an electrostatic image forming unit for forming an electrostatic image on the image bearing member; a developing unit for developing the electrostatic image, formed on the image bearing member, into a toner image; an intermediary transfer member for carrying and feeding the toner image primary-transferred thereon from the image bearing member at a primary transfer position; a rotatable secondary transfer member for secondary-transferring the toner image from the intermediary transfer member onto a recording material at a secondary transfer position by feeding the recording material by rotation thereof while sandwiching the recording material between itself and the intermediary transfer member; a constant voltage element electrically connected between the intermediary transfer member and a ground potential; a voltage source for applying a voltage to the rotatable secondary transfer member to form a secondary transfer electric field at the secondary transfer position and for passing a current through the constant voltage element to form a primary transfer electric field at the primary transfer position, wherein the apparatus is operable in a lowering mode in which the secondary transfer electric field in a trailing end region of the recording material passing through the secondary transfer position with respect to a recording material feeding direction is made lower than the secondary transfer electric field in a region from a leading end to the trailing end region of the recording material; and a controller for setting a toner image distance between consecutively formed toner images in an operation in the lowering mode, wherein the controller sets the toner image distance so as to be longer than the toner image distance when the operation in the lowering mode is not performed to prevent a toner image from being primary-transferred in a period in which the secondary transfer electric field is lowered.

According to another aspect of the present invention, there is provided an image forming apparatus comprising: a plurality of image bearing members; a plurality of charging members for electrically charging the plurality of image bearing members at charging positions; a plurality of electrostatic image forming units for forming electrostatic images on the plurality of image bearing members charged by the plurality of charging members; a plurality of developing units for developing the electrostatic images, formed on the plurality of image bearing members, into toner images; an intermediary transfer member for carrying and feeding the toner images primary-transferred thereon from the plurality of image bearing members at primary transfer positions; a rotatable secondary transfer member for secondary-transferring the toner image from the intermediary transfer member onto a recording material at a secondary transfer position by feeding the recording material by rotation thereof while sandwiching the recording material between itself and the intermediary transfer member; a constant voltage element electrically connected between the intermediary transfer member and a ground potential; a voltage source for applying a voltage to the rotatable secondary transfer member to form a secondary transfer electric field at the secondary transfer position and for passing a current through the constant voltage element to form a primary transfer electric field at the primary transfer position, wherein the apparatus operable in a lowering mode in which the secondary transfer electric field in a trailing end region of the recording material passing through the secondary transfer position with respect to a recording material feeding direction is made lower than the secondary transfer electric field in a region from a leading end to the trailing end region of the recording material; and a controller for setting a charging voltage, to be applied to at least one of the plurality of charging members, wherein the controller sets the charging voltage so as to be longer than the charging voltage, when the operation in the lowering mode is not performed, in a period in which the secondary transfer electric field is lowered.

These and other objects, features and advantages of the present invention will become more apparent upon a consideration of the following description of the preferred embodiments of the present invention taken in conjunction with the accompanying drawings.

DESCRIPTION OF THE EMBODIMENTS

Figure 1:
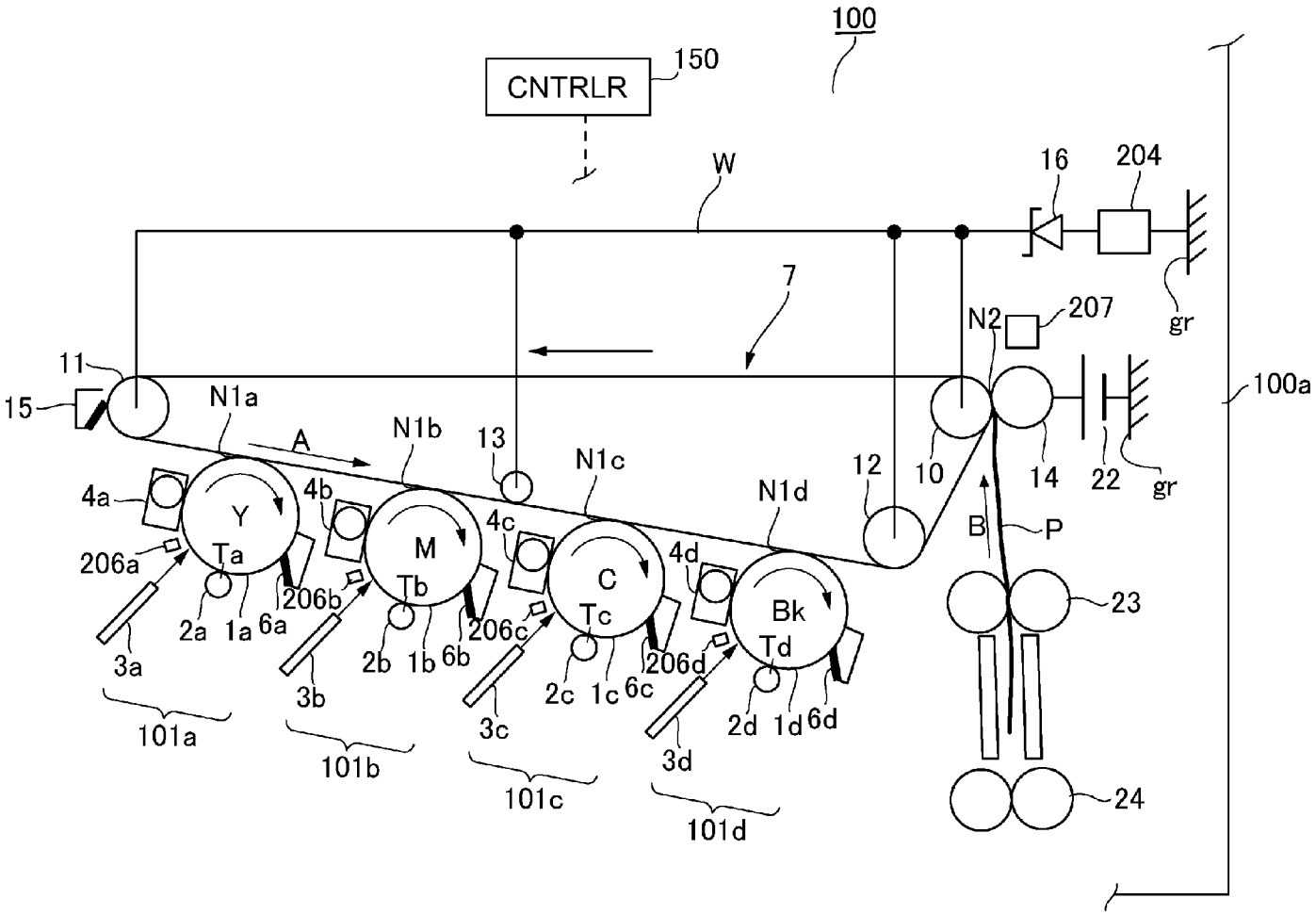
FIG. 1 is a schematic view for illustrating a basic structure of an image forming apparatus in First Embodiment according to the present invention.

In the following, embodiments of the present invention will be described along the drawings. Incidentally, in each of the drawings, the same reference numerals are assigned to elements having the same structures or functions, and the redundant description of these elements is omitted.

(First Embodiment)

First, with reference to FIG. 1, an image forming apparatus in this embodiment will be described. That is, as shown in FIG. 1, an image forming apparatus 100 includes an image forming apparatus main assembly 100*a*. The image forming apparatus 100 is constituted as a full-color printer in which image forming portions (image forming units) 101*a*, 101*b*, 101*c* and 101*d* for yellow (Y), magenta (M), cyan (C) and black (Bk), respectively, are arranged along a downward surface of an intermediary transfer belt 7 as an intermediary transfer member.

The image forming apparatus 100 not only employs a tandem type in which image forming units for respective colors are independent and arranged in tandem, but also employs an intermediary transfer type in which toner images are transferred from the image forming units for respective colors onto the intermediary transfer member, and then are transferred from the intermediary transfer member onto a recording material.

Image forming portions (image forming units) 101*a*, 101*b*, 101*c* and 101*d* include constitutions for forming yellow (Y), magenta (M), cyan (C) and black (Bk) toner images, respectively. These image forming units are disposed in the order of the image forming portions 101*a*, 101*b*, 101*c* and 101*d*, that is, in the order of yellow, magenta, cyan and black from an upstream side with respect to a movement direction (arrow A direction) of the intermediary transfer belt 7 as the intermediary transfer member.

The image forming portions 101*a*, 101*b*, 101*c* and 101*d* include photosensitive drums 1*a*, 1*b*, 1*c* and 1*d* as image bearing members, respectively, on which the toner images are formed. Charging rollers 2*a*, 2*b*, 2*c* and 2*d* are charging means for charging surfaces of the respective photosensitive drums 50*a*, 50*b*, 50*c* and 50*d*. Exposure devices 3*a*, 3*b*, 3*c* and 3*d* as electrostatic image forming means are provided with laser scanners to expose to light the photosensitive drums 1*a*, 1*b*, 1*c* and 1*d* charged by the charging rollers 2*a*, 2*b*, 2*c* and 2*d*. Outputs of the laser scanners are turned on and off on the basis of image information, whereby electrostatic images corresponding to images are formed on the photosensitive drums (image bearing members) 1*a*, 1*b*, 1*c* and 1*d*, respectively.

The charging rollers 2*a*-2*d* and the exposure devices 3*a*-3*d* function as electrostatic image forming means for forming the electrostatic images on the photosensitive drum 1*a*-1*d*, respectively. Developing devices 4*a*, 4*b*, 4*c* and 4*d* as developing means are provided with accommodating containers for accommodating the yellow, magenta, cyan and black toners, respectively and develop the electrostatic images formed on the photosensitive drum 1*a*, 1*b*, 1*c* and 1*d* using the toners. Between the exposure devices 3*a*-3*d* and the developing devices 4*a*-4*d*, potential sensors 206*a*-206*d* for detecting surface potentials of the corresponding photosensitive drums 1*a*-1*d* are provided.

The toner images formed on the photosensitive drums 1*a*, 1*b*, 1*c* and 1*d* are primary-transferred onto the intermediary transfer belt 7 at primary transfer portions N1*a*, N1*b*, N1*c* and N1*d*, so that four color toner images are transferred superimposedly onto the intermediary transfer belt 7.

The intermediary transfer belt 7 is constituted as a rotatably movable intermediary transfer member onto which the toner images are to be transferred from the photosensitive drums 1*a*-1*d* (image bearing members) and carries and feeds the toner images primary-transferred from the portions 1*a*-1*d* at the primary transfer portions (primary transfer rollers) N1*a*-N1*d*. In this embodiment, the intermediary transfer belt 7 has at least two-layer structure including a base layer and a surface layer, in which the layer toward the photosensitive drums 1*a*-1*d* is se to have a resistance value higher than a resistance value of the other layer. The base layer comprises a resin material such as polyimide, polyamide, PEN, PEEK, or various rubbers, with a proper amount of an antistatic agent such as carbon black incorporated. The base layer of the intermediary transfer belt 56 is constituted to have a volume resistivity of $10^6$-$10^8$ Ωcm thereof.

The base layer comprises the polyimide, having a center thickness of approx. 45-150 μm, in the form of a film-like endless belt. Further, as a surface layer, an acrylic coating having a volume resistivity of $10^{13}$-$10^{16}$ Ωcm is applied, so that the resistance of the base layer is constituted so as to be lower than that of the surface layer. The thickness of the surface layer is 1-10 μm. Of course, the thickness is not intended to be limited to these numerical values. By these constitutions, it is possible to realize stable primary transfer onto the intermediary transfer belt 7 and stable secondary transfer from the intermediary transfer belt 7 onto the recording material P. These constitutions regarding the intermediary transfer belt 7 are similarly applied to Second and Third Embodiments described later.

The inner peripheral surface of the intermediary transfer belt 7 is stretched by various rollers 10, 11, 12 and 13 as stretching members. Idler roller 12 stretches the intermediary transfer belt 7 extending along an arrangement direction of the respective photosensitive drums 1*a*, 1*b*, 1*c* and 1*d*. A tension roller 11 not only applies a certain tension to the intermediary transfer belt 7 but also functions also as a correction roller for preventing snaking motion of the intermediary transfer belt 7. A belt tension to the tension roller 11 is constituted so as to be about 5-12 kgf.

By this belt tension applied, nips as the primary transfer portions N1*a*, N1*b*, N1*c* and N*d* are formed between the intermediary transfer belt 7 and the respective photosensitive drums 1*a*-1*d*. An inner secondary transfer roller 10 is driven by a motor excellent in constant speed property, and functions as a driving roller for circulating and driving the intermediary transfer belt 7.

The recording material P is accommodated in an unshown recording material cassette. The recording material P is fed by a pick-up roller (not shown) at predetermined timing from the recording material cassette and is guided to a registration roller pair 23 by a feeding roller pair 24. In synchronism with the feeding of the toner image on the intermediary transfer belt 7, the recording material P is fed by the registration roller pair 23 to the secondary transfer portion N2 for transferring the toner image from the intermediary transfer belt 7 onto the recording material P. A this embodiment means for feeding the recording material P to the secondary transfer portion (secondary transfer position) N2 is constituted by the registration roller pair 23 and the feeding roller pair 24.

At a position opposing the inner secondary transfer roller 10, an outer secondary transfer roller 14 as a rotatable secondary transfer member for forming the secondary transfer portion N2 by sandwiching the intermediary transfer belt 7 between itself and the inner secondary transfer roller 10. The outer secondary transfer roller 14 presses the intermediary transfer belt 7 toward the inner secondary transfer roller 10 to form the secondary transfer portion N2 in combination with the inner secondary transfer roller 10. That is, the outer secondary transfer roller 14 rotates and feeds the recording material P between itself and the intermediary transfer belt 7 at the secondary transfer portion (secondary transfer position) N2 while sandwiching the recording material P between itself and the intermediary transfer belt 7.

Between the intermediary transfer belt 7 and a ground potential gr, positive electrode is connected to the outer secondary transfer roller 14 and a negative electrode is connected to the ground potential gr, and a secondary transfer high-voltage source 22 as a voltage source means for applying a voltage to the outer secondary transfer roller 14 is provided. That is, the secondary transfer high-voltage source 22 forms a secondary transfer electric field at the secondary transfer portion N2 by applying the voltage to the outer secondary transfer roller 14 and forms a primary transfer electric field at each of the primary transfer portions (primary transfer positions) N1*a*-N1*d* by passing a current through the Zener diode 16 as the constant voltage element. Above the outer secondary transfer roller 14, a temperature and humidity environmental sensors 207 for detecting a temperature and a humidity is provided.

The temperature and humidity environmental sensor 207 constitutes an environment detecting means for detecting an ambience (atmosphere) at a periphery of the image forming apparatus main assembly 100*a*. A controller 150 executes trailing end weak bias control (lowering mode) on the basis of the ambience, such as the temperature or the humidity, detected by the temperature and humidity environmental sensor (environment detecting means) 207.

Between the intermediary transfer belt 7 and the ground potential gr, the Zener diode 16 is electrically connected. That is, the cathode of the Zener diode 16 is provided in an inner peripheral surface side of the intermediary transfer belt 7 and is electrically connected, via wiring W, with the inner state roller 10, the tension roller 11, a stretching roller 13 and the idler roller 12 which stretch the intermediary transfer belt 7. The anode of the Zener diode 16 is electrically connected with the ground potential gr via a stretching roller inflowing current detecting circuit 204.

When the recording material P is fed to the secondary transfer portion N2, a secondary transfer voltage (secondary transfer bias) of an opposite polarity to the charge polarity of the toner is applied to the outer secondary transfer roller 14, whereby the toner image is secondary-transferred from the intermediary transfer belt 7 onto the recording material P.

Incidentally, the inner secondary transfer roller 10 is constituted by EPDM rubber. The inner secondary transfer roller 10 is set at 20 mm in diameter, 0.5 mm in rubber thickness and 70° in hardness (Asker-C). The outer secondary transfer roller 14 is constituted by an elastic layer formed of NBR rubber, EPDM rubber or the like, and a core metal. The outer secondary transfer roller 14 is formed to have a diameter of 24 mm.

With respect to a direction (arrow A direction) in which the intermediary transfer belt 7 moves, in a downstream side than the secondary transfer portion N2, a belt cleaning device 15 for removing a residual toner and paper powder which remain on the intermediary transfer belt 7 without being transferred onto the recording material P at the secondary transfer portions N2 is provided.

In the image forming apparatus 100 having the constitution described above, the recording material P fed from the unshown recording material cassette is separated one by one by a separating roller (not shown) and then is fed to the registration roller pair 23. This registration roller pair 23 feeds the recording material P to the secondary transfer portion N2 by being timed to the toner image on the intermediary transfer belt 7.

On the other hand, the toner images formed on the photosensitive drums 1*a*-1*d* image forming portions 101*a*-101*d*, respectively, are successively formed superposedly onto the intermediary transfer belt at the primary transfer portions N1*a*-N1*d* and then move toward the secondary transfer portion N2 by the rotational movement of the intermediary transfer belt 7. Then, at the secondary transfer portion N2, the four color toner images transferred on the intermediary transfer belt 7 are secondary-transferred onto the recording material P which is fed by being timed thereto by the registration roller pair. The recording material P on which the toner images are secondary-transferred is, after the toner images are heated and pressed by an unshown fixing device and thus are fixed on the surface of the recording material P, discharged onto a discharge tray (not shown) via a discharging roller (not shown).

[Primary Transfer Electric Field Formation in Primary-transfer-high-voltage-less-system]

The image forming apparatus 100 in this embodiment employs a constitution in which the voltage source exclusively for the primary transfer is omitted for cost reduction, and is constituted so as to prevent an image defect due to an insufficient current at the primary transfer portions N1*a*-N1*d* in the case where the trailing end weak bias control is carried out in the primary-transfer-high-voltage-less-system. In this embodiment, also in order to electrostatically primary-transfer the toner images from the photosensitive drums 1*a*-1*d* onto the intermediary transfer belt 7, the secondary transfer high voltage source 22 is used.

However, in the conventional constitution, i.e., in a constitution in which the rollers for stretching the intermediary transfer belt are directly connected to the ground, even when the secondary transfer high voltage source 22 applies the voltage to the outer secondary transfer roller 14, there is a liability that the current flows toward the stretching rollers 10-13. That is, in this case, even when the secondary transfer high voltage source 22 applies the voltage, the current does not flow into the photosensitive drums 1*a*-1*d* via the intermediary transfer belt 7, so that the primary transfer electric field for transferring the toner images does not act between the photosensitive drums 1*a*-1*d* and the intermediary transfer belt 7.

Therefore, in this embodiment, in order to cause a primary transfer electric field action to function in the primary-transfer-high-voltage-less-system, passive elements are provided between all the stretching rollers 10-13 and the ground to suppress passing of the current through the stretching rollers 10-13. By employing such a constitution, a potential of the intermediary transfer belt 7 becomes high, so that the primary transfer electric field acts between the photosensitive drums 1*a*-1*d* and the intermediary transfer belt 7. This embodiment to which the present invention is applied is constituted while paying attention to this point.

Incidentally, if a resistance of the intermediary transfer belt 7 itself is high, a voltage drop of the intermediary transfer belt 7 becomes large, and therefore, there is also a liability that the current is less liable to pass through the photosensitive drums 1*a*-1*d* via the intermediary transfer belt 7. For that reason, the intermediary transfer belt 7 may desirably have a low-resistant layer. In this embodiment, in order to suppress the voltage drop in the intermediary transfer belt 7, the base layer of the intermediary transfer belt 7 is constituted so as to have a surface resistivity of $10^2$ Ω/square or more and $10^8$ Ω/square or less.

Figure 3:
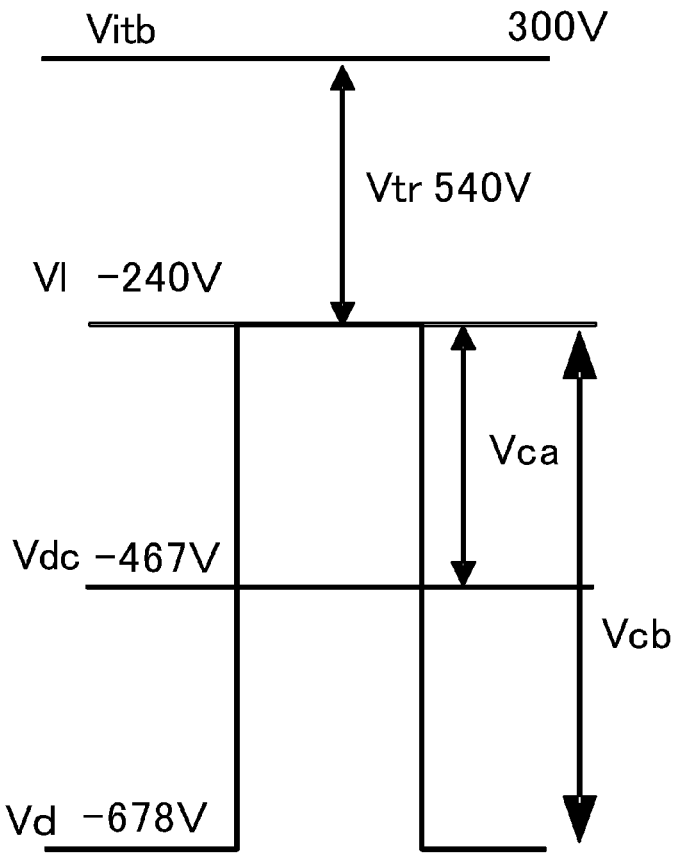
FIG. 3 is a schematic view showing a primary between a transfer potential and an electrostatic image potential in First Embodiment.

Next, by using FIG. 3, a primary transfer contrast which is a difference between the potential of each of the photosensitive drums 1*a*-1*d* and the potential of the intermediary transfer belt 7 will be described. FIG. 3 is a schematic view showing a relationship between a transfer potential and an electrostatic image potential in this embodiment.

That is, as shown in FIG. 3, the surfaces of the photosensitive drums 1*a*-1*d* are electrically charged by the charging rollers 2*a*-2*d*, respectively, so that the surface potential of each photosensitive drum becomes Vd (−678 (V) in this embodiment). Then, the surfaces of the photosensitive drums 1*a*-1*d* are exposed to light by the exposure device 3, and the surface of each photosensitive drum has a potential V1 (−240 V in this embodiment). The potential Vd is the potential of the non-image portion where the toner is not deposited, and the potential V1 is the potential of an image portion where the toner is deposited. Vitb shows the potential of the intermediary transfer belt 7.

The surface potential S of the photosensitive drums 1*a*-1*d* are controlled by the controller 150 (FIG. 2) as the control means on the basis of detection results of potential sensors 206*a*-206*d* provided in proximity to the photosensitive drums 1*a*-1*d* in a downstream side of the charging rollers 2*a*-2*d* and the exposure means devices 3*a*-3*d* and in an upstream side of the developing devices 4*a*-4*d*.

The potential sensors 206*a*-206*d* detect the non-image portion potentials and the image portion potentials of the surfaces of the photosensitive drums 1*a*-1*d*, and the controller 150 controls charging potentials of the charging rollers 2*a*-2*d* on the basis of the non-image portion potentials and controls exposure light amounts of the exposure devices 3*a*-3*d* on the basis of the image portion potentials. By this control, with respect to the surface potential of each of the photosensitive drums 1*a*-1*d*, both of the image portion potential and the non-image portion potential can be set at proper values.

With respect to this charging potential on the photosensitive drum, a developing bias Vdc (−467 V as a DC component in this embodiment) is applied by each of the developing devices 4*a*-4*d*, so that a negatively charged toner is formed in the photosensitive drum side (image bearing member side) by development.

A developing contrast Vca which is a potential difference between the V1 of each of the photosensitive drums 1*a*-1*d* and the developing bias Vdc is: −240 (V)−(−467 (V))=227 (V).

An electrostatic image contrast Vcb which is a potential difference between the image portion potential V1 and the non-image portion potential Vd is: −240 (V)−(−678 (V))=438 (V).

A primary-transfer contrast Vtr which is a potential difference between the image portion potential V1 of each of the photosensitive drums 1*a*-1*d* and the potential Vitb (300 V in this embodiment) of the intermediary transfer belt 7 is: 300 V−(−240 (V))=540 (V).

[VI Characteristic of Zener Diode 16]

In the primary-transfer-high-voltage-less-system, the primary transfer is determined by the primary transfer contrast which is the potential difference between the potential of the intermediary transfer belt 7 and the potential of each of the photosensitive drums 1*a*-1*d*. For that reason, in order to stably form the primary transfer contrast, it is desirable that the potential of the intermediary transfer belt 7 is kept constant.

Therefore, in this embodiment, the Zener diode 16 is used as a passive element disposed between the ground and each of the inner secondary transfer roller 10, the tension roller 11, the idler roller 12 and the stretching roller 13.

Figure 4:
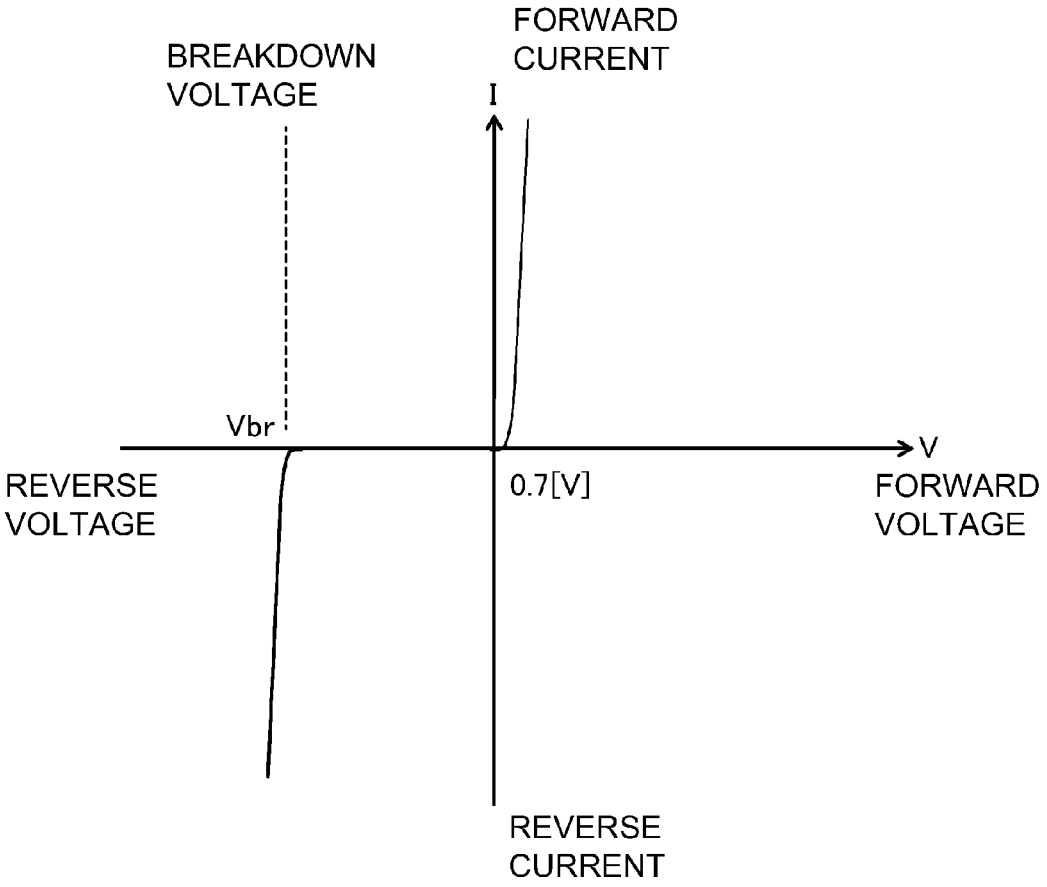
FIG. 4 is a graph showing an IV characteristic of a Zener diode.

FIG. 4 shows a voltage-current characteristic of the Zener diode. During application of a reverse (direction) voltage, the Zener diode 16 causes the current to little flow until a voltage of Zener breakdown voltage Vbr or more is applied, but has a characteristic such that the current abruptly flows when the voltage of the Zener breakdown voltage or more is applied. Further, during application of a forward (direction) voltage, e.g., at 0.7 (V), the Zener diode 16 causes a forward (direction) current to flow. That is, in a range in which the voltage applied to the Zener diode 16 is the Zener breakdown voltage Vbr or more, during the application of the reverse voltage, the voltage drop of the Zener diode 16 is kept constant at a Zener voltage.

In this embodiment, by using such a voltage-current characteristic of the Zener diode 16, the potential of the intermediary transfer belt 7 is kept constant.

That is, in this embodiment, the Zener diode 16 is disposed as the passive element between the ground and each of the rollers 10-13. In addition, during the primary transfer, the secondary transfer high voltage source 22 applies the voltage (bias) so that the voltage applied to the Zener diode 16 is kept in a range of the Zener breakdown voltage Vbr or more. As a result, during the primary transfer, the belt potential of the intermediary transfer belt 7 can be kept constant.

In this embodiment, between the ground and the rollers 10-13 which are the stretching rollers, e.g., 12 pieces of the Zener diode 16 providing the Zener breakdown voltage Vbr of, e.g., 25 V are disposed in a state in which they are connected in series. That is, in the range in which the voltage applied to the Zener diode 16 is the Zener breakdown voltage or more, the potential of the intermediary transfer belt 7 is kept constant at the sum of the Zener breakdown voltages of the respective Zener diodes 16, i.e., 25×12=300 V.

Of course, the present invention is not intended to be limited to the constitution in which the plurality of Zener diodes are used. It is also possible to employ a constitution using only one Zener diode 16.

Of course, the surface potential of the intermediary transfer belt 7 is not intended to be limited to a constitution in which the surface potential is 300 V. The surface potential may desirably be appropriately set depending on the species of the toner and a characteristic of the photosensitive drum.

[Zener Breakdown Voltage Detection]

In this embodiment, in order to discriminate whether the voltage applied to the Zener diode 16 is within the range of not less than the Zener breakdown voltage or out of the range, the stretching roller inflowing current detecting circuit 204 (FIG. 1) for detecting a current flowing into the ground via the Zener diode 16 is provided. The stretching roller inflowing current detecting circuit 204 constitutes a current detecting means.

During non-detection of the current by the stretching roller inflowing current detecting circuit 204, the controller 150 (FIG. 2) discriminates that the voltage applied to the Zener diode 16 is out of the range of not less than the Zener breakdown voltage. On the other hand, when the stretching roller inflowing current detecting circuit 204 detects the current, the controller 150 discriminates that the voltage applied to the Zener diode 16 is within the range of not less than the Zener breakdown voltage.

[Control System of Image Forming Apparatus]

Figure 2:
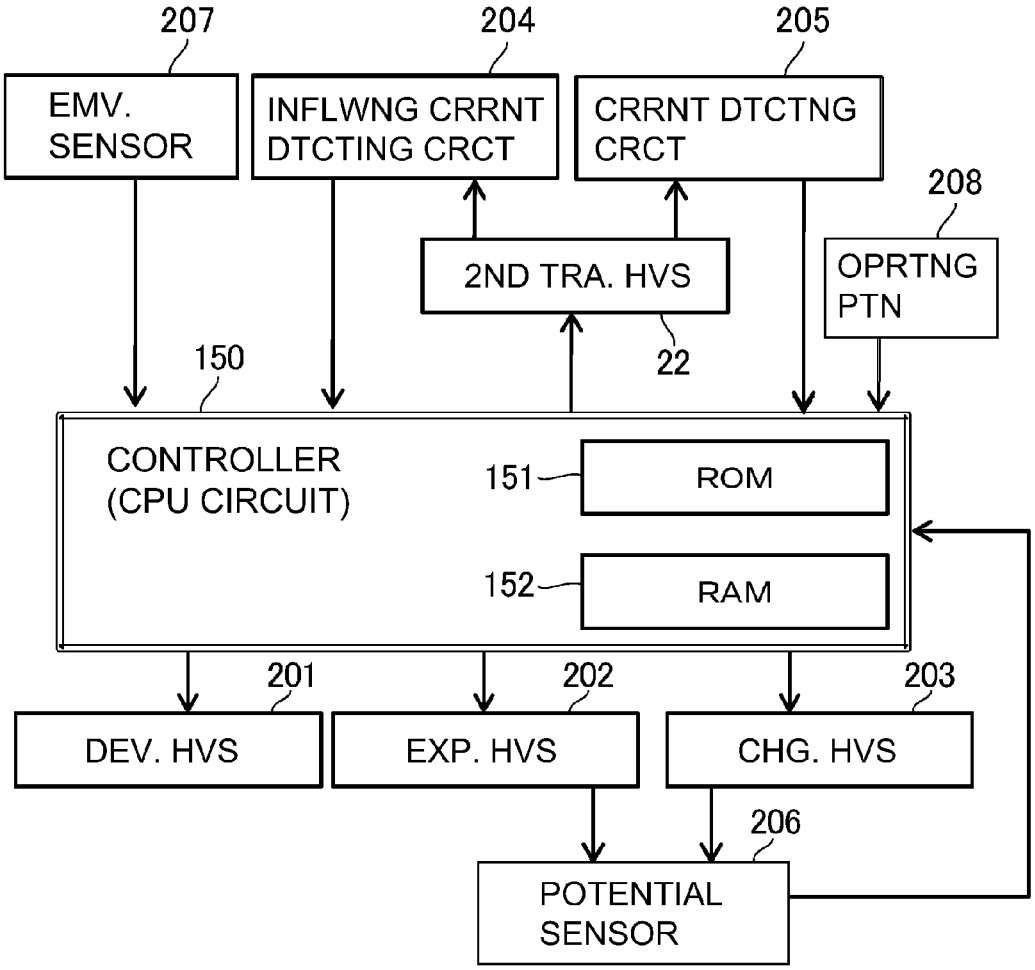
FIG. 2 is a block diagram showing a control system in First Embodiment.

A control system for effecting control of an entirety of the image forming apparatus will be described with reference to FIG. 2. FIG. 2 is a block diagram showing the control system in this embodiment.

As shown in FIG. 2, the control system, in this embodiment includes the controller (CPU control portion) 150, as a control means, in which ROM 151 and RAM 152 are incorporated. Into the controller 150, various detection signals (information) from the temperature and humidity environmental sensor 207 for detecting the temperature and humidity, the stretching roller inflowing current detecting circuit 204 and the secondary portion current detecting circuit 205, and operation signals (information) from an operating portion 208 provided on the apparatus main assembly 100*a* are inputted. The operating portion 208 constitutes an information detecting means for detecting information on the recording material P. This constitution is similarly applied to Second and Third Embodiments described later.

The controller 150 is constituted so as to be capable of executing the trailing end weak bias control (lowering mode) in which with respect to the recording material feeding direction (arrow B direction in FIG. 1) of the recording material passing through the secondary transfer portion N2, the secondary transfer electric field in a trailing end region of the recording material is made lower than the secondary transfer electric field in a region from a leading end of the recording material to the trailing end region of the recording material. When the controller 150 outputs a signal to the secondary transfer high-voltage source 22 to cause the secondary transfer high-voltage source 22 to output voltages (biases) to the rollers 10-13, the current detecting circuit 204 detects currents passing through the rollers 10-13, and the current detecting circuit 205 detects a current passing through the secondary transfer portion N2.

Further, the controller 150 outputs signals to a developing high-voltage source 201, an exposure high-voltage source 202 and a charging high-voltage source 203. The potential sensors 206 (206*a*-206*d*) detect the surface potentials of the photosensitive drums 1*a*-1*d* when the voltages (biases) are outputted from the exposure high-voltage source 202 and the charging high-voltage source 203, and then output detection signals to the controller 150.

The controller 150 effects integral control of the secondary transfer high voltage source 22, the developing high voltage source 201, the exposure high voltage source 202 and the charging high voltage source 203 on the basis of control programs stored in the ROM 151. An environment table and a recording material thickness (paper thickness) correspondence table which are described later are stored in the ROM 151, and are called up and reflected by the CPU. The RAM 152 temporarily holds control data, and is used as an operation area of arithmetic processing with the control.

[Control of Secondary Transfer High Voltage Source for Optimizing Secondary Transfer Electric Field]

In order to optimize the secondary transfer electric field for transferring the toner image from the intermediary transfer belt 7 onto the recording material P, the secondary transfer high voltage source 22 is controlled by the controller 150.

An optimum secondary transfer electric field changes depending on an ambient environment and a species of the recording material. Therefore, in this embodiment, in order to optimize the secondary transfer electric field for transferring the toner image onto the recording material, an adjusting step for secondary transfer which step is called ATVC (Active Transfer Voltage Control) in which an adjusting voltage is applied is executed by the controller 150 during non-secondary transfer before the secondary transfer step in which the toner image is transferred onto the recording material. That is, the controller 150 functions as an executing portion for executing the adjusting step for the secondary transfer.

The ATVC as the adjusting step is carried out by applying a plurality of adjusting voltage, which are constant-voltage-controlled, from the secondary transfer high voltage source 22, and then by measuring currents passing through the secondary transfer portions N2 by a secondary transfer portion current detecting circuit 205 when the adjusting voltages are applied. By the ATVC, a correction between the voltages and the currents can be calculated.

Further, on the basis of the calculated correlation between the voltages and the currents, a voltage V1 for causing a secondary transfer target current It required for the secondary transfer to flow is calculated. The secondary transfer target current It is set on the basis of a maximum shown in Table 1 below.

TABLE 1

| | WC*1 (g/m$^2$) | | | | | | |
|---|---|---|---|---|---|---|---|
| | 0.8 | 2 | 6 | 9 | 15 | 18 | 22 |
| STTC*2 (μA) | 31 | 31 | 30 | 30 | 29 | 28 | 25 |

*1"WC" represents water content.
*2"STTC" represents the secondary transfer target current.

Table 1 is a table stored in a storing portion (ROM 151) provided in the CPU circuit portion 150. This table sets and divides the secondary transfer target current It depending on absolute water content (g/m$^3$) in an atmosphere. When the water content is increased, the secondary transfer target current is decreased. Incidentally, the absolute water content is calculated by the controller 150 from the temperature and relative humidity which are detected by the temperature and humidity environmental sensor 207. Incidentally, in this embodiment, the absolute water content is used, but the water content is not intended to be limited to this. The place of the absolute water content, it is also possible to use the relative humidity.

Further, a recording material sharing voltage V2 is added to the voltage V1. The recording material sharing voltage V2 is set on the basis of a matrix shown in Table 2 below.

TABLE 2

| PLAIN PAPER | | | | | | | | |
|---|---|---|---|---|---|---|---|---|
| 64-79 (g/m$^2$) | WC*1 | 0.8 | 2 | 6 | 9 | 15 | 18 | 22 |
| (UNIT: V) | OS*2 | 900 | 900 | 850 | 800 | 750 | 500 | 400 |
| | ADS*3 | 1000 | 1000 | 950 | 900 | 850 | 750 | 500 |
| | MDS*4 | 1000 | 1000 | 950 | 900 | 850 | 750 | 500 |
| 80-105 (g/m$^2$) | WC*1 | 0.8 | 2 | 6 | 9 | 15 | 18 | 22 |
| (UNIT: V) | OS*2 | 950 | 950 | 900 | 850 | 800 | 550 | 450 |
| | ADS*3 | 1050 | 1050 | 1000 | 950 | 900 | 800 | 550 |
| | MDS*4 | 1050 | 1050 | 1000 | 950 | 900 | 800 | 550 |
| 106-105 (g/m$^2$) | WC*1 | 0.8 | 2 | 6 | 9 | 15 | 18 | 22 |
| (UNIT: V) | OS*2 | 1000 | 1000 | 950 | 900 | 850 | 600 | 500 |
| | ADS*3 | 1100 | 1100 | 1050 | 1000 | 950 | 850 | 600 |
| | MDS*4 | 1100 | 1100 | 1050 | 1000 | 950 | 850 | 600 |
| 129-105 (g/m$^2$) | WC*1 | 0.8 | 2 | 6 | 9 | 15 | 18 | 22 |
| (UNIT: V) | OS*2 | 1050 | 1050 | 1000 | 950 | 900 | 650 | 550 |
| | ADS*3 | 1150 | 1150 | 1100 | 1050 | 1000 | 900 | 650 |
| | MDS*4 | 1150 | 1150 | 1100 | 1050 | 1000 | 900 | 650 |

*1"WC" represents the water content.
*2"OS" represents one side (printing).
*3"ADS" represents automatic double side (printing).
*4"MDS" represents manual double side (printing).

Table 2 is a table stored in the storing portion provided in the CPU circuit portion 150. This table sets and divides the recording material sharing voltage V2 depending on the absolute water content (g/m$^3$) in an atmosphere and a recording material basis weight (g/m$^2$). When the basis weight is increased, the recording material sharing voltage V2 is increased. Further, when the absolute water content is increased, the recording material sharing voltage V2 is decreased. Further, the recording material sharing voltage V2 is larger during automatic double-side printing and during manual double-side printing than during one-side printing.

Incidentally, the basis weight is a unit showing a weight per unit area (g/m$^2$), and is used in general as a value showing a thickness of the recording material. With respect to the basis weight, there are the case where a user inputs the basis weight at an operating portion and the case where the basis weight of the recording material is inputted into the accommodating portion for accommodating the recording material. On the basis of these pieces of information, the controller 150 discriminate the basis weight.

A voltage (V1+V2) obtained by adding the recording material sharing voltage V2 to the voltage V1 for passing the secondary transfer target current It is set, during the secondary transfer step subsequent to the adjusting step, as a secondary transfer target voltage Vt, for secondary transfer, which is constant-voltage-controlled. As a result, a proper voltage value is set depending on an adjusting voltage environment and a recording material thickness. Further, during the secondary transfer, the secondary transfer voltage is applied in a constant-voltage-controlled state, and therefore even when a width of the recording material is changed, and secondary transfer is carried out in a stable state.

[Control of Electrostatic Image Forming Means for Optimizing Primary Transfer]

In this embodiment, in order to form a proper secondary transfer contrast, the voltage applied by the secondary transfer high voltage source 22 is changed.

For example, in the case where an absolute water content is 9 (g/m$^3$), the controller 150 changes a sharing voltage V2 of the recording material from 800 V to 950 V in the case where the recording material of 150 (g/m$^2$) in basis weight is subjected to one-side printing after the recording material of 64 (g/m$^2$) in basis weight is subjected to the one-side printing. Or, in the case where the absolute water content is 9 (g/m$^3$), even when a condition such that the recording material of 64 (g/m$^2$) in basis weight is subjected to the one-side printing is the same, if a resistance value of the outer secondary transfer roller 14 changes with time, the controller 150 changes the voltage V1 for passing the secondary transfer target current It (30 μA). Or, even when the condition such that the recording material of 64 (g/m$^2$) in basis weight is subjected to the one-side printing is the same, the controller 150 changes the secondary transfer target current It and the recording material sharing voltage between the case where the absolute water content is 9 (g/m$^3$) and the case where the absolute water content is 0.8 (g/m$^3$).

However, in the primary-transfer-high-voltage-less-system which is the constitution from which the voltage source (power source) exclusively for the primary-transfer is omitted, also a primary-transfer contrast is formed by using the secondary transfer high voltage source 22. For that reason, when the controller 150 changes the voltage applied by the secondary transfer high voltage source 22 in order to optimize the secondary transfer electric field, in the case where the primary transfer is carried out simultaneously with the secondary transfer, there is a liability that the primary transfer contrast between each of the photosensitive drums 1*a*-1*d* and the intermediary transfer belt 7 is changed. As a result, there is a liability that the proper primary transfer contrast cannot be formed and therefore a primary transfer defect is caused to occur.

Therefore, in this embodiment, in the case where the voltage applied to the secondary transfer high voltage source 22 is changed in the image portion potential of each of the photosensitive drums 1*a*-1*d* is controlled in the range in which the voltage drop of the Zener diode 16 is maintained at the Zener breakdown voltage or more.

For that reason, in the primary-transfer-HV-less system, even when the voltage applied by the secondary transfer high voltage source 22 is changed in order to optimize the secondary transfer contrast, a change in primary transfer electric field is suppressed. As a result, it is possible to form a proper primary transfer contrast.

The primary transfer contrast is set on the basis of a table of Table 3 below. Table 3 is the table stored in a storing portion (ROM 151) provided in the controller 150, and shows a relationship between the primary transfer contrast and the ambient environment. This table sets and divides the primary transfer contrast portion the colors (Y, M, C and Bk) and the ambient environment.

TABLE 3

| | WATER CONTENT (g/m$^3$) | | | | | | |
|---|---|---|---|---|---|---|---|
| | 22 | 18 | 15 | 9 | 6 | 2 | 0.8 |
| Y | 480 | 525 | 560 | 580 | 605 | 615 | 630 |
| M | 440 | 485 | 520 | 540 | 565 | 575 | 590 |
| C | 440 | 485 | 520 | 540 | 565 | 575 | 590 |
| Bk | 390 | 435 | 470 | 490 | 515 | 525 | 540 |

For example, the case where the ambient environment in which the absolute water content is 9 (g/m$^3$), the one-side printing of the recording material of 64 (g/m$^2$) in basis weight is selected by a user and then the one-side printing of the recording material of 150 (g/m$^2$) is selected by the user will be described. In this case, the sharing voltage V2 of the recording material changes from 800 V to 950 V, and therefore the secondary transfer target voltage Vt changes. On the other hand, a thickness of the recording material does not relate to the primary transfer, and therefore a proper primary transfer contrast does not change.

Therefore, in order to optimize the secondary transfer contrast, the voltage applied to the outer secondary transfer roller 14 by the secondary transfer high voltage source 22 is changed. However, the secondary transfer is carried out in a range in which the voltage applied to the Zener diode 16 is the Zener breakdown voltage or more, so that the potential of the intermediary transfer belt 7 is kept constant a 300 V. Further, the electrostatic image forming condition of the electrostatic image forming means is maintained without charging the electrostatic image condition of the electrostatic image forming means. As a result, the primary transfer contrasts for the respective colors of Y, C, C and Bk are maintained at proper values of 580 V, 540 V, 540 V and 490 V, respectively.

[Trailing End Weak Bias Control (Lowering Mode) at a Secondary Transfer Portion]

In the case where a recording material large i rigidity such as thick paper is passed through the secondary transfer portion N2 in a conventional constitution, in the recording material trailing end region, a gap is formed between the intermediary transfer belt 7 and the recording material, so that there is a possibility that the toner image scatters or the image defect due to abnormal electric discharge generates. Therefore, in this embodiment, a trailing end weak bias constitution in which the image defect such as the toner image scattering is prevented by making the transfer bias in the recording material trailing end region lower than the transfer bias in the region from the recording material leading end to the recording material trailing end region is employed.

For example, in the case of the recording materials having the basis weights from 60 (g/m$^2$), a possibility of the generation of the image defect is very low, and therefore a certain secondary transfer bias from passing of the recording material leading end through the secondary transfer portion N2 to passing of the recording material trailing end through the secondary transfer portion N2. However, in the case of the recording materials (thick papers) having the basis weights from 151 (g/m$^2$) to 300 (g/m$^2$), a possibility of the generation of the image defect is high, and therefore the secondary transfer bias in the recording material trailing end region is made lower than the secondary transfer bias in the region from the recording material leading end to the recording material trailing end region.

The timing when the secondary transfer bias is lowered is a point of 50 mm in front of the recording material portion, and the secondary transfer bias is lowered stepwisely. In this embodiment, in the case where the absolute water content is 0.8 (g/m$^3$), a certain secondary transfer bias is applied so that the secondary transfer target current It=32 (μA) flows from the leading end of the recording material to a distance of 50 mm in front of the trailing end of the recording material. The secondary transfer bias is switched stepwisely from the point of 50 mm in front of the recording material trailing end so that the current of 22 (μA) which is about 70% of the secondary transfer target current It passes through the trailing end portion of the recording material.

In this way, there is a liability that the control in which the secondary transfer bias is switched during passing of the recording material P through the secondary transfer portion N2 causes a lowering in transfer efficiency at the secondary transfer portion N2. For that reason, the image is stabilized when the certain secondary transfer bias is applied so that the secondary transfer target current It=32 (μA) passes through the entirety of the recording material if possible.

However, depending on the species of paper (recording material), in order to suppress the image defect such as the scattering, a countermeasure to prevent the image defect even when the secondary transfer efficiency is somewhat lowered is taken. Particularly, when the basis weight of the recording material increases, a resistance of the recording material increases, and therefore the secondary transfer voltage for passing the secondary transfer target current through the recording material becomes high, so that abnormal electric discharge is liable to generate in the recording material trailing end region. Further, in a lower temperature and lower humidity environment, the water content of the recording material lowers to increase the resistance value of the recording material, and therefore a higher secondary transfer voltage is needed.

[Sequence during Continuous Sheet Passing]

A sequence in the case where the image is continuously formed on a plurality of sheets of the recording material will be described. In this embodiment, the image forming apparatus 100 capable of outputting 30 sheets per min. in the case where the process speed is 130 (mm/sec) and the recording material used in A4 in size and 64 (g/m$^2$) in basis weight. A distance from the secondary transfer portion N2 to the upstreammost station N1*a* of the primary transfer portions N1*a*-N1*d* is 259 mm, a distance between adjacent photosensitive drums is 63 mm, and a distance from the secondary transfer portion N2 to the downstreammost station N1*d* of the primary transfer portions N1*a*-N1*d* is 70 mm.

A4 size is 297 mm in length and 210 mm in width, and therefore in the case where A4-sized sheets are continuously passed, a length of an interval between (two) recording materials (hereinafter referred to as a sheet interval) is 51.7 (mm). That is, at the time when the region of 50 mm in front of the recording material trailing end of the first sheet reaches the secondary transfer portion N2, an image forming operation of the second sheet is performed at the primary transfer portions N1*a*-N1*d*. Also in the case where the recording material size is different, the sheet interval is the same as in the case of the A4-sized recording material.

Figure 12:
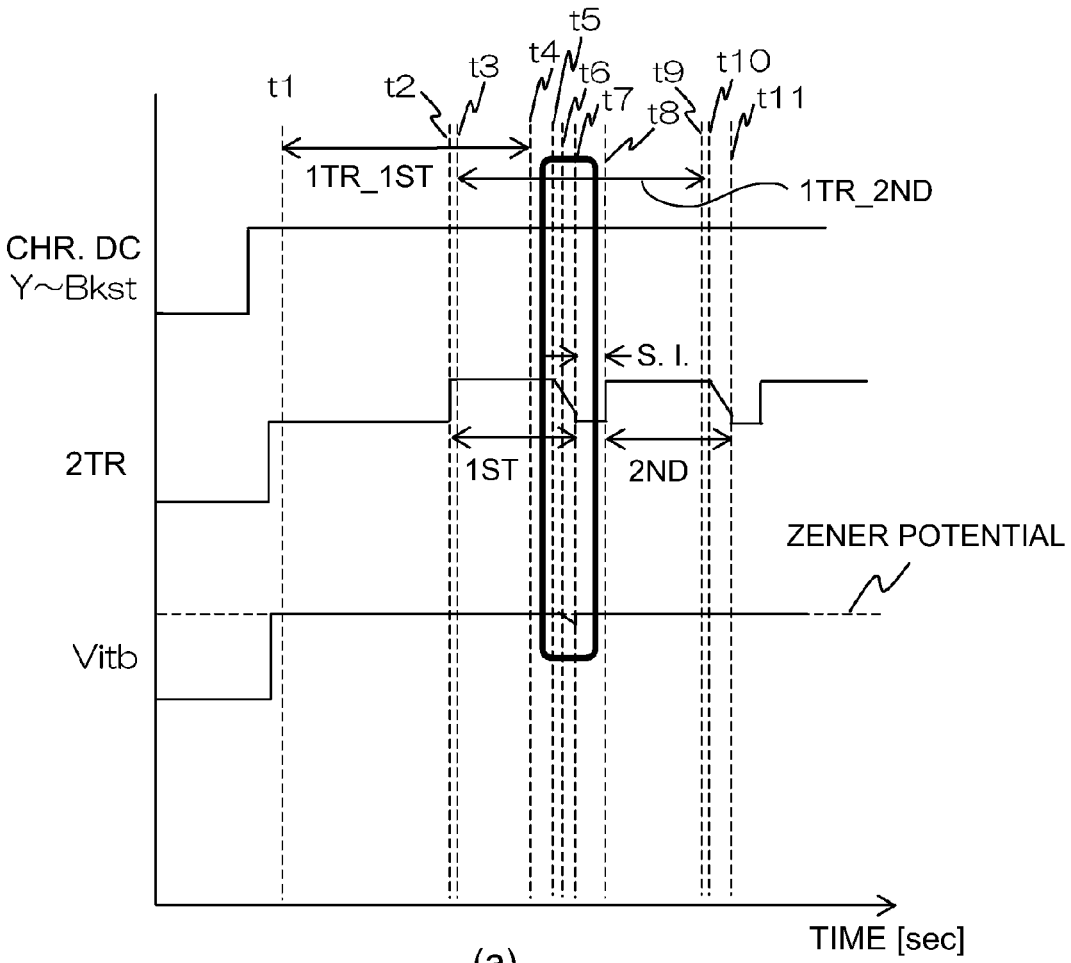
In FIG. 12, (a) and (b) are timing charts regarding a sheet interval distance in a comparison example.
Figure 12:
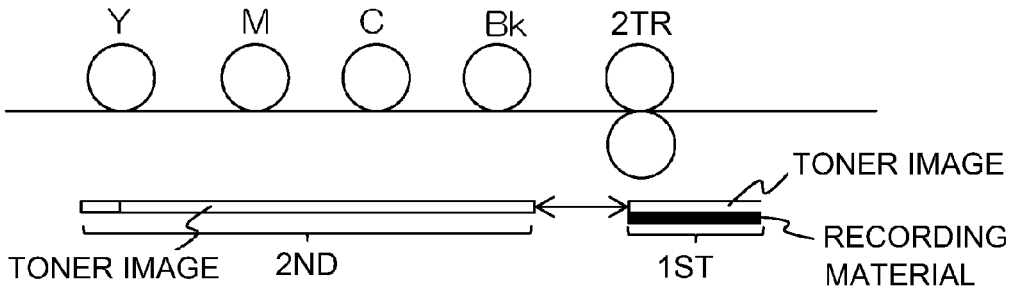

In (a) and (b) of FIG. 12, timing charts in the case where when the present invention is not applied, the trailing end weak bias control (lowering mode) is carried out at the sheet interval of 51.7 (mm) during the continuous passing of the A4-sized sheets in the primary-transfer-high-voltage-less-system are shown.

In (a) and (b) of FIG. 12, t1 shows a time when the image formation of the first sheet of the recording material is started at the Y station 101*a*, t2 shows a time when the secondary transfer of the first sheet of the recording material is started, and t3 shows a time when the image formation of the second sheet of the recording material is started at the Y station 101*a*. Further, t4 shows a time when the image formation of the first sheet of the recording material is ended at the Bk station 101*d*, t5 shows a time when the trailing end weak bias control of the first sheet of the recording material is started, and t6 shows a time when the potential Vitb of the intermediary transfer belt starts to be below the Zener potential.

Further, t7 shows a time when the secondary transfer of the first sheet of the recording material is ended, t8 shows a time when the secondary transfer of the second sheet of the recording material is started, and t9 shows a time when the image formation of the second sheet of the recording material is ended at the Bk station. Further, t10 shows a time when the trailing end weak bias control of the second sheet of the recording material is started, and t11 shows a time when the secondary transfer of the second sheet of the recording material is ended.

As shown in (a) and (b) of FIG. 12, in the primary-transfer-high-voltage-less-system to which the present invention is not applied, the image formation at the primary transfer portions N1*a*-N1*d* and the secondary transfer portion N2 is realized only by the high voltage (bias) at the secondary transfer portion N2, and therefore, the following problem arises.

That is, at timing (t5-t7) when the high voltage is lowered at the secondary transfer portion N2 in the recording material trailing end region, when the image formation at the primary transfer portions N1*a*-1Nd is carried out, the current at the primary transfer portion becomes insufficient. As a result, the potential Vitb of the intermediary transfer belt 7 is below the Zener potential (t6-t7), so that the case where the image formation at the primary transfer portions N1*a*-N1*d* was not optimally effected was caused to generate.

Figure 5:
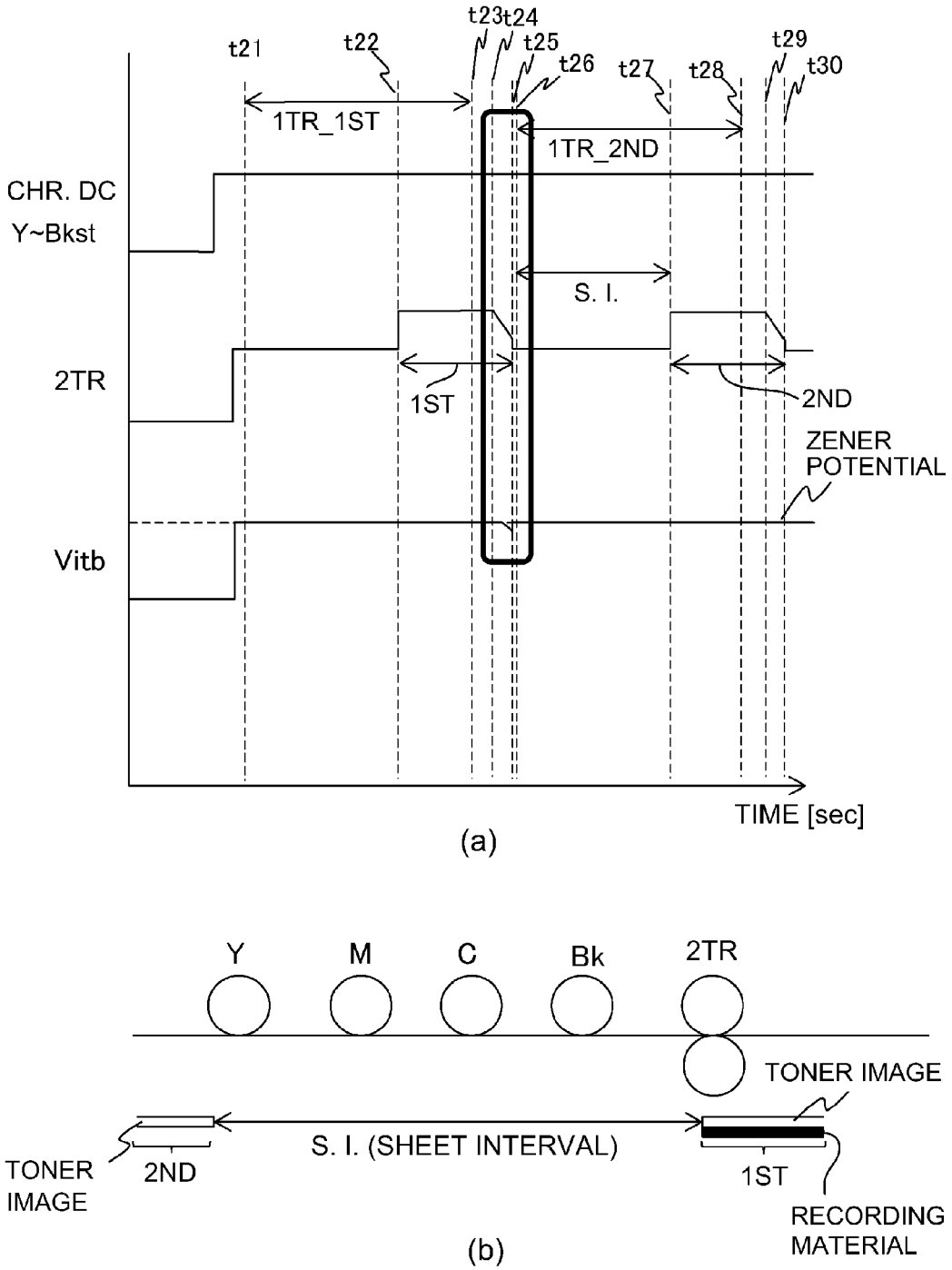
In FIG. 5, (a) and (b) are timing charts in First Embodiment.

In FIG. 5, (a) and (b) are timing charts for illustrating the action in this embodiment in which a constitution capable of solving such a problem is employed. As shown in (a) and (b) of FIG. 5, t21 shows a time when the image formation of the first sheet of the recording material is started at the Y station 101*a*, t22 shows a time when the secondary transfer of the first sheet of the recording material is started, and t23 shows a time when the image formation of the first sheet of the recording material is ended at the Bk station 101*b*. Further, t24 shows a time when the trailing end weak bias control of the first sheet of the recording material is started, and t25 shows a time when the secondary transfer of the first sheet of the recording material is ended, and t26 shows a time when the image formation of the second sheet of the recording material is started at the Y station.

Further, t27 shows a time when the secondary transfer of the second sheet of the recording material is started, and t28 shows a time when the image formation of the second sheet of the recording material is ended at the Bk station. Further, t29 shows a time when the trailing end weak bias control of the second sheet of the recording material is started, and t30 shows a time when the secondary transfer of the second sheet of the recording material is ended.

In this embodiment, as shown in (a) and (b) of FIG. 5, in the case where the trailing end weak bias control is carried out at the secondary transfer portion N2, the following constitution is employed. That is, a constitution in which the sheet interval is increased so that the image formation of the second sheet is started (t26) after the recording material trailing end region of the first sheet passes through the secondary transfer portion N2 and the potential Vitb of the intermediary transfer belt 7 is returned to a state exceeding the Zener potential is employed. That is, control is effected so that a toner image distance between two toner images (i.e., a sheet interval distance) consecutively formed at the primary transfer portions N1*a*-N1*d* is changed (i.e., increased) relative to the toner image distance in the case where the trailing end weak bias control is not carried out.

Specifically, in the case where the trailing end weak bias control is carried out with respect to the A4-sized recording material, a constitution in which the sheet interval is increased from 51.7 (mm) to 259 (mm). In the case of A3 size (420 mm (length)×297 mm (width)), there is a possibility that the sheet interval is increased due to fixing power of the fixing device (not shown). In this case, the sheet interval determined from the fixing power of the fixing device (not shown) is compared with 259 (mm), and then a larger sheet interval is employed.

Figure 6:
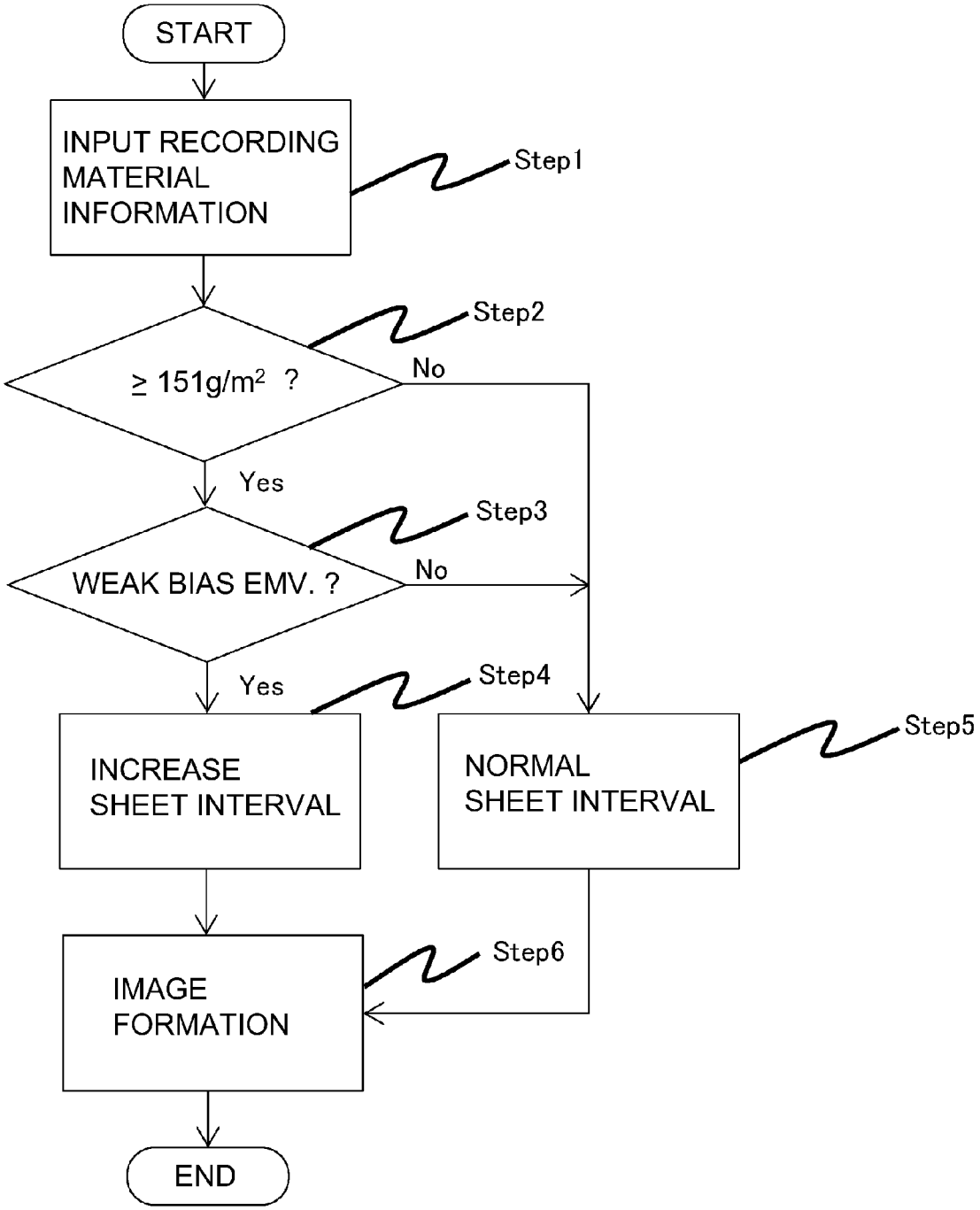
FIG. 6 is a flowchart showing the action in First Embodiment.

The action in this embodiment will be described with reference to a flowchart of FIG. 6. That is, first, a user inputs information, on the recording material used, such as the species, the basis weight or the size through an operating portion 208 of an operating panel, and then pushes a start button (not shown) of an image forming operation (Step 1).

Then, a signal during this operation is inputted into the controller (CPU circuit portion) 150. As a result, the controller 150 discriminates whether or not the basis weight of the recording material is 151 (g/m$^2$) or more (Step 2). Together with this discrimination, the controller 150 discriminates, on the basis of information inputted from the temperature and humidity environmental sensor (environment detecting means) 207, whether or not an environment in which the image forming apparatus 100 is disposed is an environment in which there is a need to carry out the trailing end weak bias control (Step 3).

In this way, the controller 150 carries out the trailing end weak bias control on the basis of the recording material information (such as the basis weight) detected (inputted) by the operating portion (information detecting means) 208 and further on the basis of the ambient condition detected by the temperature and humidity environmental sensor 207. As a result, it is possible to accurately discriminate a status requiring the trailing end weak bias control.

As a result, the controller 150 moves the sequence to an operation in a sheet interval (toner image distance) increasing mode in the case where the condition (Step 3) is satisfied (Step 4), and moves the sequence to an operation in a normal mode, in which the sheet interval is not increase, in the case where the condition is not satisfied (Step 5), and then starts the image forming operation (Step 6).

In this way, in this embodiment, the controller 150 effects the following control so that the toner image is not transferred in a period in which the secondary transfer electric field (secondary transfer voltage) is lowered when the trailing end weak bias control is executed. That is, the controller 150 effects control so that the toner image distance (sheet interval distance) between the toner images consecutively formed at the image forming portions 101*a*-101*d* is made longer (i.e., broader) than the toner image distance in the case where the trailing end weak bias control is not carried out.

In this way, in a period (timing) in which the primary transfer is not effected with respect to at least one photosensitive drum, the sheet interval distance is increased so that the control in which the secondary transfer electric field (secondary transfer voltage) in the trailing end region of the recording material P is made lower than the secondary transfer electric field (secondary transfer voltage) in the region from the leading end of the recording material P to the trailing end region of the recording material P can be effected. In this case, in the period in which the control in which the secondary transfer voltage in the trailing end region of the recording material P is made lower than the secondary transfer voltage in the region from the leading end and the trailing end region of the recording material P is effected, the primary transfer is effected with respect to the remaining photosensitive drums other than at least one photosensitive drum described above.

By the above, even in the case where the trailing end weak bias control is effected in the primary-transfer-high-voltage-less-system, it is possible to provide the image forming apparatus 100 having the constitution in which the image defect due to insufficient current at the primary transfer portions N1*a*-N1*d* is not generated when the secondary transfer bias is lowered in the recording material trailing end region.

<Second Embodiment>

Next, with reference to FIGS. 1, 7 and 8, Second Embodiment according to the present invention will be described. In this embodiment, the constitution of FIG. 1 is similar to that in First Embodiment, but control using the constitution is somewhat different from that in First Embodiment.

Figure 7:
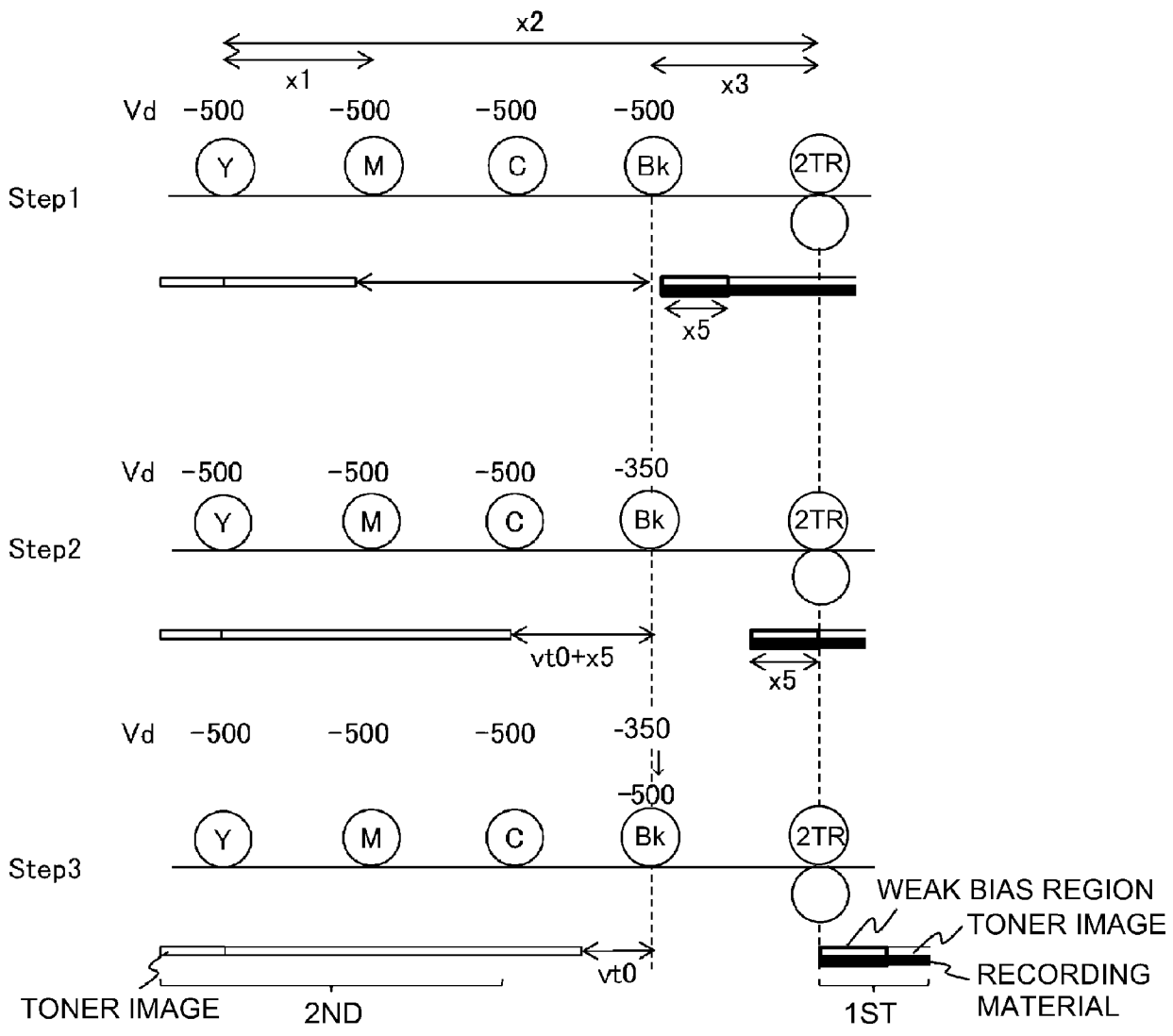
FIG. 7 is an illustration regarding switching of a charging high voltage (DC component) in Second Embodiment according to the present invention.
Figure 8:
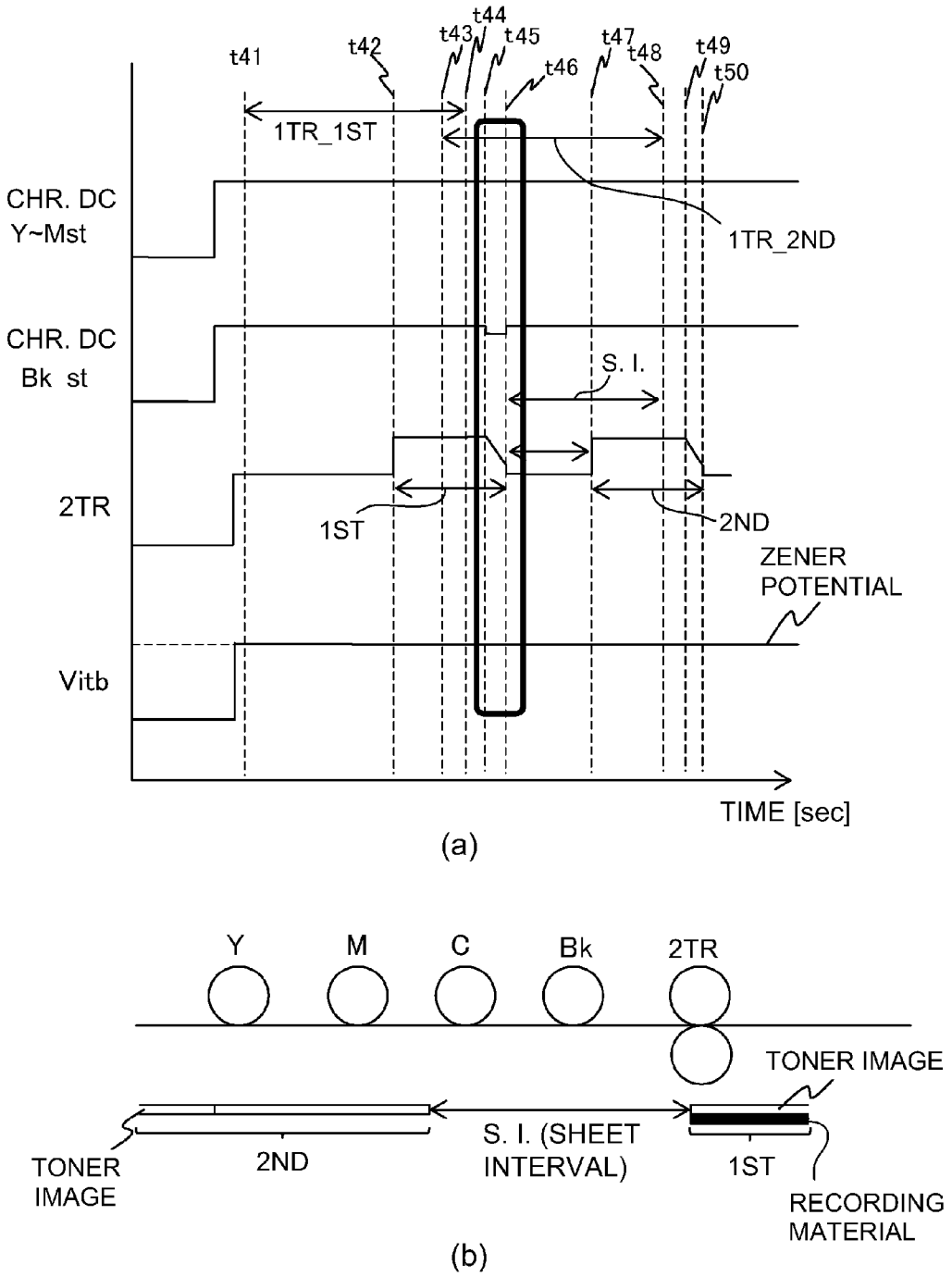
In FIG. 8, (a) and (b) are timing charts in Second Embodiment.

FIG. 7 is an illustration of switching of the charging high voltage (DC component) in this embodiment, and (a) and (b) of FIG. 8 are timing charts in this embodiment. The same members as those in First Embodiment are represented by the same reference numerals or symbols, and the members having the same constitutions and functions as those in First Embodiment will be omitted from description.

In First Embodiment, in the case where the trailing end weak bias control was carried out, the control was effected in the following manner. That is, the controller 150 increased the sheet interval distance during the continuous sheet passing so that the image forming operation at the primary transfer portions N1*a*-N*d* was started after the recording material trailing end region passed through the secondary portion N2 and the potential Vitb of the intermediary transfer belt 7 was returned to the state exceeding the Zener potential. On the other hand, in this embodiment, a constitution in which the trailing end weak bias control (lowering mode) is carried ut while further suppressing a lowering in productivity due to generation of downtime or the like is employed.

That is, in this embodiment, when the trailing end weak bias control is carried out in the primary-transfer-high-voltage-less-system, the image defect due to the insufficient current at the primary transfer portions N1*a*-N1*d* is obviated, and the generation of the downtime during the continuous sheet passing is further suppressed. In this embodiment, an image forming apparatus which is a low-speed machine to a medium-speed machine for office use in which the distance from the primary transfer portion N1*d* at the downstreammost station 101*d* to the secondary transfer portion N2 is relatively short will be described.

In this embodiment, the charging rollers 2*a*-2*d* shown in FIG. 1 constitute the plurality of charging means for electrically charging the photosensitive drums 1*a*-1*d*, which are the plurality of image bearing members, at the charging positions Ta-Td, respectively. The exposure devices 3*a*-3*d* constitute the plurality of electrostatic image forming means for forming the electrostatic images on the photosensitive drums 1*a*-1*d*, respectively, charged by the charging rollers (charging means) 2*a*-2*d*.

Further, in this embodiment, the developing devices 4*a*-4*d* constitute the plurality of developing means for developing the electrostatic images, formed on the photosensitive drums 1*a*-1*d* , into the toner images, respectively. The intermediary transfer belt 7 constitutes the intermediary transfer member for carrying and feeding the toner images primary-transferred from the photosensitive drums 1*a*-1*d* at the primary transfer portions (primary transfer positions) N1*a*-N1*d*, respectively. In this embodiment, between the intermediary transfer belt 7 as the intermediary transfer member and the ground potential gr, the Zener diode 16 is electrically connected. Also in this embodiment, the secondary transfer high-voltage source 22 constitutes the same voltage source means as the secondary high-voltage source 22 in First Embodiment.

The controller 150 in this embodiment is capable of executing the trailing end weak bias control (lowering mode) in which with respect to the recording material feeding direction of the recording material passing through the secondary transfer portion (secondary transfer position) N2, the secondary transfer voltage in a trailing end region of the recording material is made lower than the secondary transfer voltage in the region from a leading end of the recording material to the trailing end region of the recording material. When the trailing end weak bias control is effected, the controller 150 effects control so that the charging voltage to be applied to at least one of the charging rollers 2*a*-2*d* in a period in which the secondary transfer electric field (secondary transfer voltage) is lowered is made lower than the charging voltage in the case where the trailing end weak bias control is not effected. In this case, the above-described at least one of the charging rollers 2*a*-2*d* is the charging roller 2*d* closest to the secondary transfer portion (secondary transfer position) N2 with respect to the feeding direction (arrow A direction in FIG. 1) of the intermediary transfer belt 7.

[Sequence during Continuous Sheet Passing]

A sequence in the case where the image is continuously formed on a plurality of sheets of the recording material will be described. In this embodiment, similarly as in First Embodiment, the image forming apparatus 100 capable of outputting 30 sheets per min. in the case where the process speed is 130 (mm/sec) and the recording material used in A4 in size and 64 (g/m$^2$) in basis weight. A distance from the secondary transfer portion N2 to the upstreammost station 101*a* of the primary transfer portions N1*a*-N1*d* is 259 mm, a distance between adjacent photosensitive drums is 63 mm, and a distance from the secondary transfer portion N2 to the downstreammost station 101*d* of the primary transfer portions N1*a*-N1*d* is 70 mm. Further, a switching time of the high voltage DC components for the charging belts 2*a*-2*d* is 100 (msec), and the region in which the trailing end weak bias control is carried out is the region of 50 mm in front of the trailing end of the recording material.

A4 size is 297 mm in length and 210 mm in width, and therefore in the case where A4-sized sheets are continuously passed in a long edge feeding manner, a length of an interval between (two) recording materials (sheet interval) is 51.7 (mm). Also in the case where the recording material size is different, the sheet interval is the same as in the case of the A4-sized recording material.

FIG. 7 is an illustration of switching of the charging high voltage (DC component) in this embodiment. In FIG. 7, x1 shows a distance between adjacent photosensitive drums, x2 shows a distance from the Y sheet 101*a* to the secondary transfer portion N2, x3 shows a distance from the Bk station 101*d* to the secondary transfer portion N2, and x5 shows a distance in which the trailing end weak bias control is carried out with respect to the recording material. Further, v shows the process speed of the image forming apparatus 100, and t0 shows a time required for switching the charging high voltage (DC component).

As shown in FIG. 7, in this embodiment, the charging high voltage (DC component) for the downstreammost station (Bk: 101*d*) is switched at the sheet interval, and the sheet interval L is L=(v×t0+×3) (mm). First, the image formation of the first sheet of the recording material is carried out in the order of Y, M, C and Bk (Step 1).

Next, before the trailing end weak bias control of the first sheet of the recording material at the secondary transfer portion N2 is carried out, only the charging portion (charging voltage) Vd of the Bk station 101*d* is switched from a set value during the image formation (Step 2).

In this case, Vd is switched from −500 (V) to −350 (V). By switching only the charging potential Vd for the Bk station, it becomes possible to maintain a state in which the potential Vitb of the intermediary transfer belt 7 exceeds the Zener potential. For that reason, it becomes possible to carry out proper primary transfer at the Y to C stations (101*a* to 101*c*) simultaneously with the trailing end weak bias control at the secondary transfer portion N2.

Finally, after the secondary transfer of the first sheet of the recording material is ended, the controller 150 returns the charging potential Vd for the Bk station 101*d* to the set value of −500 (V) during the image formation (Step 3). In this embodiment, a constitution in which the sheet interval is increased from 51.7 (mm) to 83.0 (mm) which is not less than the distance from the secondary transfer portion N2 to the Bk station 101*d* and which is not more than the distance from the secondary transfer portion N2 to the C station 101*c* is employed.

In this embodiment, the trailing end weak bias control is carried out in the sheet interval between the recording materials consecutively fed to the secondary transfer portion N2. This sheet interval is not less than the distance from the secondary transfer portion N2 to the primary transfer portion N1*d*, of the primary transfer portions N1*a*-N1*d*, closest to the secondary transfer portion N2 with respect to the feeding direction of the intermediary transfer belt 7. As a result, it is possible to start the image formation after the charging voltage is returned to the original value with reliability at the Bk station 101*d*.

The controller 150 in this embodiment lowers the charging voltage to be applied to the charging rollers (charging means) 2*a*-2*d*, and thereafter returns the voltage to the voltage before the lowering, and then forms the electrostatic images on the photosensitive drums 1*a*-1*d* by the corresponding exposure devices 3*a*-3*d*. For this reason, at the Bk station 101*d*, by the charging voltage returned to the original voltage, it is possible to effect the proper image formation. That is, at the Bk station 101*d*, the image formation is started after the charging potential Vd is returned to the original value, and therefore the primary transfer is optimally carried out.

In FIG. 8, (a) and (b) are timing charts in this embodiment. In (a) of FIG. 8, t41 shows a time when the image formation of the first sheet of the recording material is started at the Y station 101*a*, t42 shows a time when the secondary transfer of the first sheet of the recording material is started, and t43 shows a time when the image formation of the second sheet of the recording material is started at the Y station 101*a*. Further, t44 shows a time when the image formation of the first sheet of the recording material is ended at the Bk station 101*d*, t45 shows a time when the trailing end weak bias control of the first sheet of the recording material is started, and t46 shows a time when the secondary transfer of the first sheet of the recording material is ended. Further, t47 shows a time when the secondary transfer of the second sheet of the recording material is started, t48 shows a time when the image formation of the second sheet of the recording material is ended at the Bk station, t49 shows a time when the trailing end weak bias control of the second sheet of the recording material is started, and t50 shows a time when the secondary transfer of the second sheet of the recording material is ended.

As shown in FIG. 8, in the case where the trailing end weak bias control is carried out at the secondary transfer portion N2, by switching only the charging potential Vd for the Bk station 101*d* (t45-t46), it is possible to maintain a state in which the potential Vitb of the intermediary transfer belt 7 always exceeds the Zener potential. As a result, it is possible to carry out proper primary transfer at the Y to C stations (image forming portions 101*a* to 101*c*) simultaneously with the trailing end weak bias control at the secondary transfer portion N2.

By the above, even in the case where the trailing end weak bias control is effected in the primary-transfer-high-voltage-less-system, it is possible to provide the image forming apparatus 100 having the constitution in which the image defect due to insufficient current at the primary transfer portions N1*a*-N1*d* is not generated when the secondary transfer bias is lowered in the recording material trailing end region. Further, even in the case where the trailing end weak bias control is effected in the primary-transfer-high-voltage-less-system, it is possible to more effectively suppress the generation of the downtime during the continuous sheet passing.

<Third Embodiment>

Figure 9:
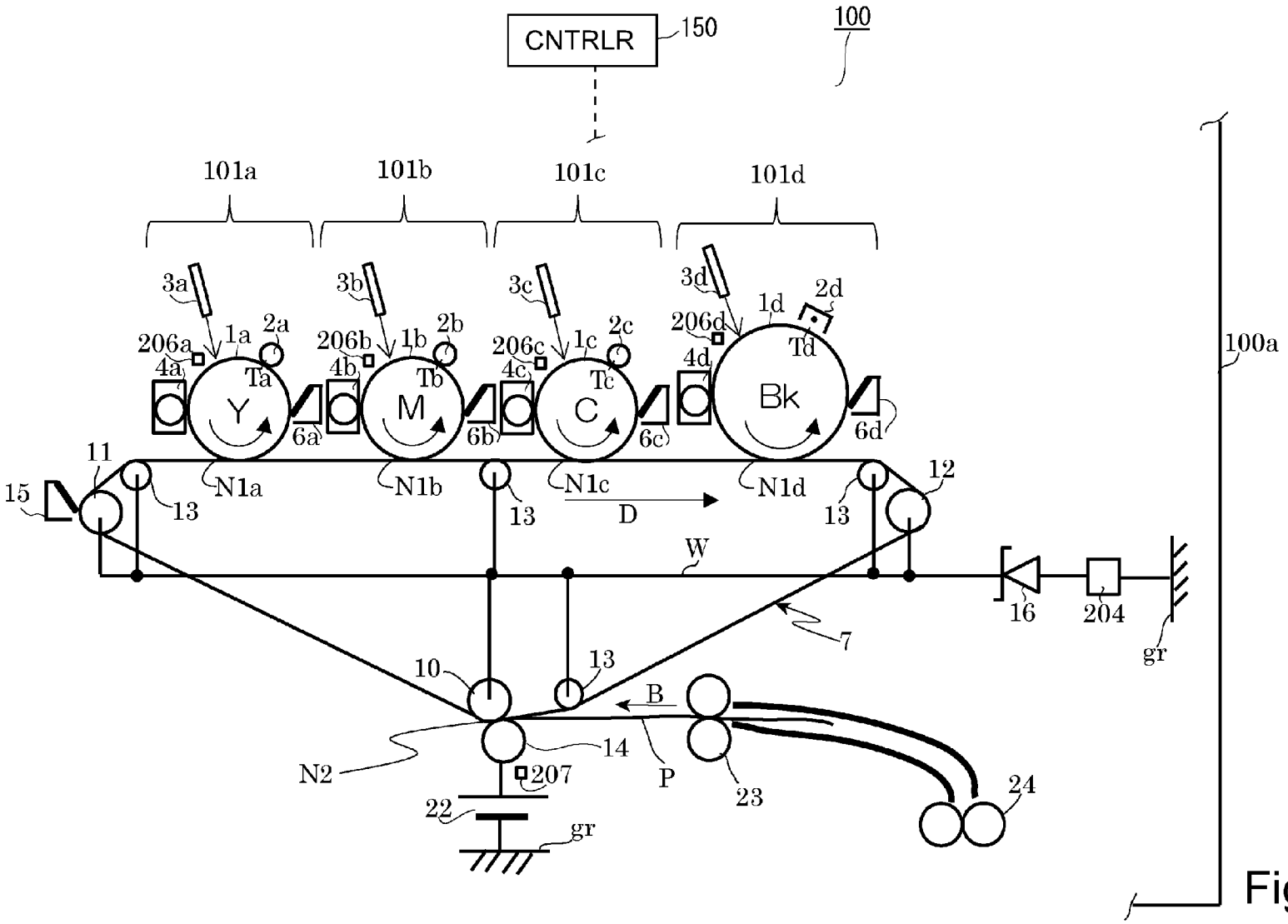
FIG. 9 is a schematic view for illustrating a basic structure of an image forming apparatus in Third Embodiment according to the present invention.
Figure 10:
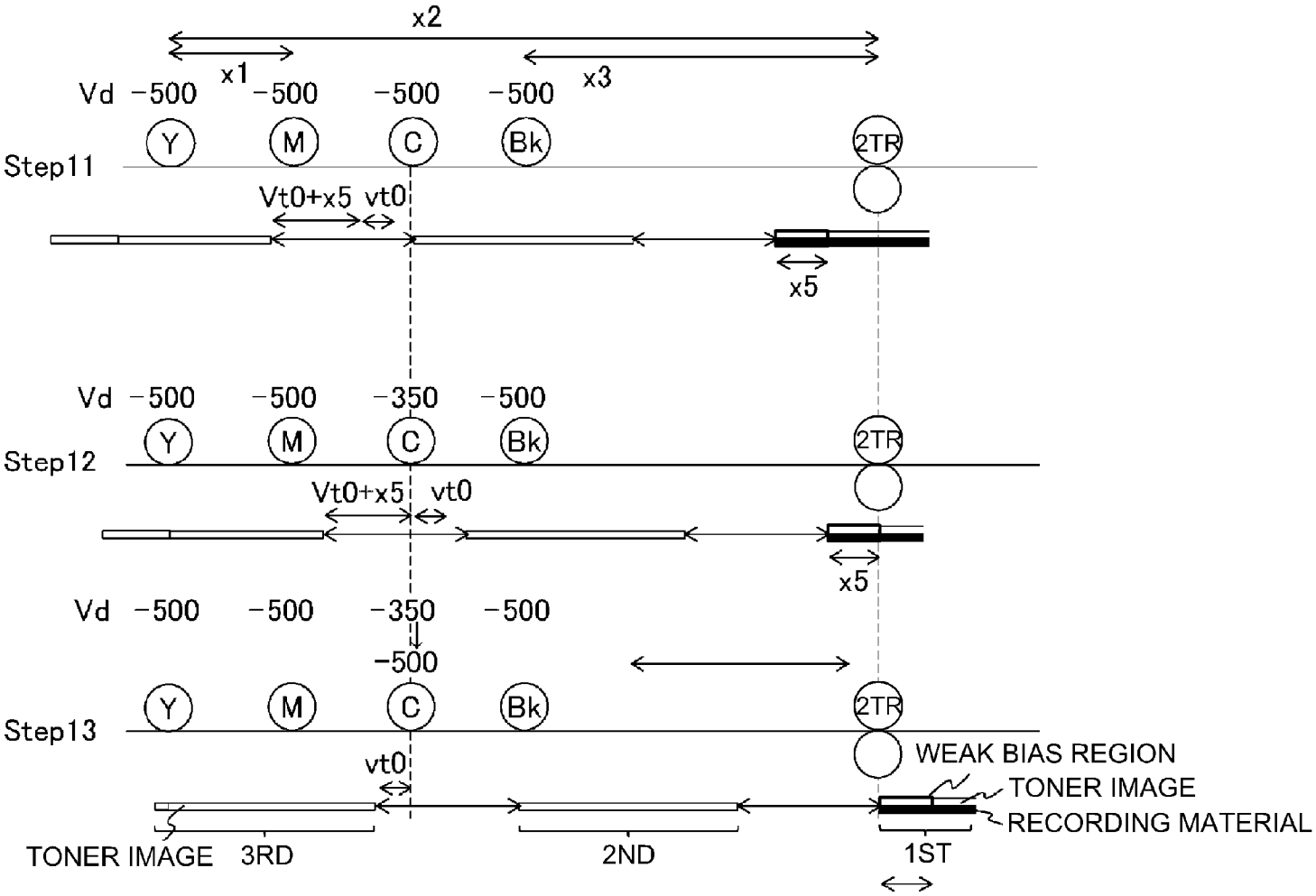
FIG. 10 is an illustration regarding switching of a charging high voltage (DC component) in Third Embodiment.
Figure 11:
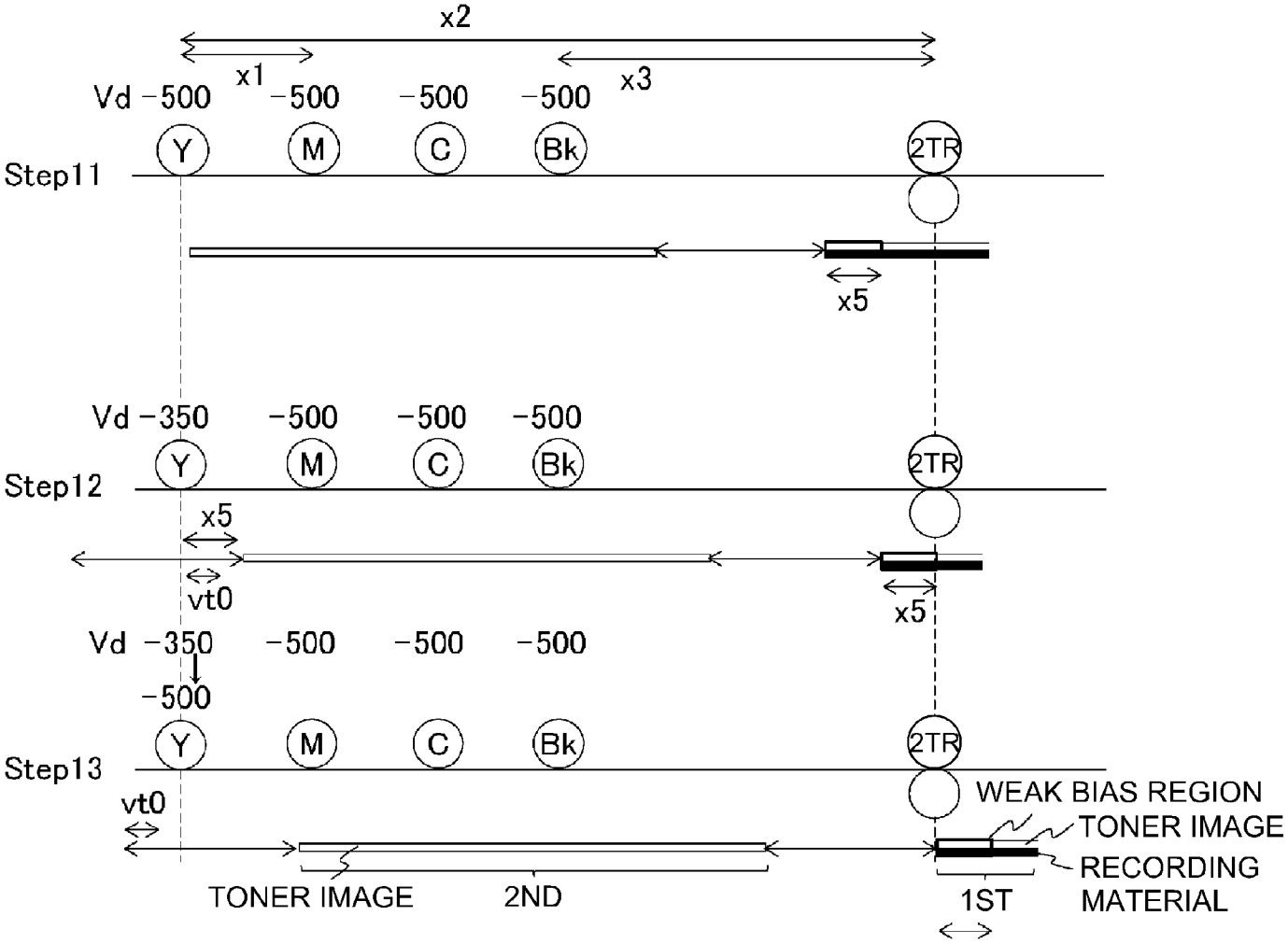
FIG. 11 is an illustration regarding another switching of the charging high voltage (DC component) in Third Embodiment.

Next, with reference to FIGS. 9, 10 and 11, Third Embodiment according to the present invention will be described. FIG. 9 is a schematic view for illustrating a basic structure of an image forming apparatus 100 in this embodiment. FIG. 10 is an illustration of switching of a charging high voltage (DC component) in this embodiment, and FIG. 11 is an illustration of switching of a charging high voltage (DC component) in this embodiment. The same members as those in First Embodiment are represented by the same reference numerals or symbols, and the members having the same constitutions and functions as those in First Embodiment will be omitted from description.

As shown in FIG. 9, the image forming apparatus 100 is constituted as an intermediary transfer type full-color printer of a tandem type in which image forming portions (image forming units) 101*a*, 101*b*, 101*c* and 101*d* for yellow (Y), magenta (M), cyan (C) and black (Bk), respectively, are arranged along an upward surface of an intermediary transfer belt 7 as an intermediary transfer member.

The image forming portions 101*a*, 101*b*, 101*c* and 101*d* are disposed in the order of the image forming portions 101*a*, 101*b*, 101*c* and 101*d*, that is, in the order of yellow, magenta, cyan and black from an upstream side with respect to a movement direction (arrow D direction) of the intermediary transfer belt 7 as the intermediary transfer member. These image forming portions 101*a*-101*d* have substantially the same constitutions as those of the image forming apparatus 100 described with reference to FIG. 1. Also in this embodiment, similarly as in First Embodiment, the charging rollers 2*a*-2*d* and the exposure devices 3*a*-3*d* function as the electrostatic image forming means, and the developing devices 4*a*-4*d* function as the developing means.

The inner peripheral surface of the intermediary transfer belt 7 is stretched by the inner secondary transfer roller 10, the tension roller 11, the idler roller 21 and a plurality of stretching rollers 13. The recording material P is fed by a pick-up roller (not shown) at predetermined timing from a recording material cassette (not shown) and is guided to a registration roller pair 23 by a feeding roller pair 24. The outer secondary transfer roller 14 disposed at a position opposing the inner secondary transfer roller 10 presses the intermediary transfer belt 7 toward the inner secondary transfer roller 10 to form the secondary transfer portion N2.

Between the intermediary transfer belt 7 and the ground potential gr, the Zener diode 16 is electrically connected. That is, between the intermediary transfer belt 7 and the ground potential gr, the Zener diode 16 and the stretching roller inflowing current detecting circuit 204 are connected in series. The Zener diode 16 is electrically connected via the stretching roller inflowing current detecting circuit 204 between the ground potential or and the above rollers 10-13.

Further, the secondary transfer high-voltage source 22 for applying the transfer voltage for forming the secondary transfer electric field at the secondary transfer portion N2 by applying a voltage to the outer secondary transfer roller 14 and for forming the primary transfer electric field at the primary transfer portions N1*a*-N1*d* by passing the current through the Zener diode 16 is provided. The secondary transfer high-voltage source 22 is connected with the outer secondary transfer roller 14 at the positive electrode thereof and is connected with the ground potential gr at the negative electrode thereof, so that the secondary transfer high-voltage source 22 applies the voltage to the outer secondary transfer roller 14. Below the outer secondary transfer roller 14, the temperature and humidity environmental sensor 207 for detecting the temperature and the humidity is provided. Also the controller 150 in this embodiment executes the trailing end weak bias control (lowering mode) on the basis of the ambient condition such as the temperature or the humidity detected by the temperature and humidity environmental sensor 207.

In the image forming apparatus 100 in this embodiment, when the recording material P sent from the recording material cassette is fed to the registration roller pair 23, the registration roller pair 23 feeds the recording material P to the secondary transfer portion N2 by being timed to the toner image on the intermediary transfer belt 7. On the other hand, the toner images formed on the photosensitive drums 1*a*-1*d*, respectively, are successively formed superposedly onto the intermediary transfer belt at the primary transfer portions N1*a*-N1*d* and then move toward the secondary transfer portion N2 by the rotational movement of the intermediary transfer belt 7. Then, at the secondary transfer portion N2, the four color toner images on the intermediary transfer belt 7 are secondary-transferred onto the recording material P. The recording material P is, after the toner images are fixed on the surface of the recording material P, discharged onto a discharge tray (not shown).

This embodiment is suitable for being applied to the image forming apparatus for the purpose from light POD (Print On Demand) to POD, in which the distance from the downstreammost station of the primary transfer portions N1*a*-N1*d* to the secondary transfer portion. In this embodiment, in the image forming apparatus 100, in the case where the trailing end weak bias control is carried out in the primary-transfer-high-voltage-less-system, the image defect due to the insufficient current at the primary transfer portions N1*a*-N1*d* is prevented, and the generation of the downtime during the continuous sheet passing is suppressed.

[Sequence during Continuous Sheet Passing]

A sequence in the case where the image is continuously formed on a plurality of sheets of the recording material will be described. That is, in this embodiment, the image forming apparatus 100 capable of outputting 60 sheets per min. in the case where the process speed is 320 (mm/sec) and the recording material used in A4 in size and 64 (g/m$^2$) in basis weight.

A distance from the secondary transfer portion N2 to the upstreammost station 101*a* of the primary transfer portions N1*a*-N1*d* is 700 mm. Further, a distance between adjacent photosensitive drums is 120 mm, and a distance from the secondary transfer portion N2 to the downstreammost station 101*d* of the primary transfer portions N1*a*-N1*d* is 340 mm. Further, a switching time of the high voltage DC components for the charging belts 2*a*-2*d* is 100 (msec), and the region in which the trailing end weak bias control is carried out is the region of 50 mm in front of the trailing end of the recording material.

A4 size is 297 mm in length and 210 mm in width, and therefore in the case where A4-sized sheets are continuously passed in a long edge feeding manner, the sheet interval is 111.9 (mm). Also in the case where the recording material size is different, the sheet interval is the same as in the case of the A4-sized recording material.

FIG. 10 is an illustration of switching of the charging high voltage (DC component) in this embodiment in which A4-sized sheets are continuously passed. FIG. 11 is an illustration of switching the charging high voltage (DC component) in this embodiment in which A3-sized sheets are continuously passed.

As shown in FIG. 10, the image formation of the first sheet of the recording material is carried out in the order of Y, M, C and Bk (Step 11). Next, before the trailing end weak bias control of the first sheet of the recording material at the secondary transfer portion N2 is carried out, only the charging portion Vd of the C station is switched from a set value during the image formation (Step 12). In this case, Vd is switched from −500 (V) to −350 (V). By switching only the charging potential Vd for the Bk station, it becomes possible to maintain a state in which the potential Vitb of the intermediary transfer belt 7 exceeds the Zener potential. For that reason, it becomes possible to carry out the primary transfer at the Y, M and Bk stations simultaneously with the trailing end weak bias control at the secondary transfer portion N2.

Finally, after the secondary transfer of the first sheet of the recording material is ended, the controller 150 returns the charging potential Vd for the C station to the set value of −500 (V) during the image formation (Step 13). At the C station, the image formation is started after the charging potential Vd is returned to the original value, and therefore the primary transfer is optimally carried out. In this embodiment, in the case where the A4-sized sheets are continuously passed, a constitution in which the sheet interval is increased from 111.9 (mm) to 141.0 (mm) is employed.

Further, in the case where the A3-sized sheets are continuously passed, the charging potential Vd for the Y station 101*a* may only be required to be switched, so that a constitution in which the sheet interval is increased from 111.9 (mm) to 156.0 (mm) is employed.

In this embodiment, the station for which the charging high voltage (DC component) is switched in the sheet interval is not limited. In this embodiment, in the case where the trailing end weak bias control is carried out at the secondary transfer portion N2, simultaneously with the trailing end weak bias control, the primary transfer is prevented from being carried out at any one of the Y, M, C and Bk stations. For that reason, the sheet interval is made larger than the sheet interval in the case where the trailing end control is not effected, and the charging high voltage (DC component) is switched in the sheet interval. Therefore, an optimum value of the sheet interval (distance) varies depending on the distance between adjacent stations, the distance from the Bk station to the secondary transfer portion N2, the distance in which the trailing end weak bias control is effected for the recording material, the process speed of the image forming apparatus, and the time required for switching of the charging high voltage (DC component).

Further, in this embodiment, the recording material size is not limited to the A4 size and the A3 size. This embodiment is also carried out for other recording material sizes such as B5 size and postcard size, so that the optimum value of the sheet interval (distance) and the station for which the charging high voltage (DC component) is switched in the sheet interval are different depending on the recording material size.

By the above, even in the case where the trailing end weak bias control is effected in the primary-transfer-high-voltage-less-system, it is possible to provide the image forming apparatus 100 having the constitution in which the image defect due to insufficient current at the primary transfer portions N1*a*-N1*d* is not generated when the secondary transfer bias is lowered in the recording material trailing end region. Further, even in the case where the trailing end weak bias control is effected in the primary-transfer-high-voltage-less-system, it is possible to more effectively suppress the generation of the downtime during the continuous sheet passing.

The present invention can be carried out is not only the image forming apparatus of the two-component development type but also an image forming apparatus of a one-component development type. The present invention can be carried out in any of image forming apparatuses of a tandem type and a one-drum type so long as the image forming apparatus is provided with the intermediary transfer belt. The image bearing member is not limited to the organic photosensitive member but may also be an inorganic photosensitive member such as an amorphous silicon photosensitive member. The image bearing member is not limited to the drum-like image bearing member but may also be a belt-like image bearing member. Also with respect to the charging type, the developing type, the transfer type, the belt cleaning type and the fixing type, any type thereof is selectable. In the above-described embodiments, only the principal part of the toner image formation and transfer was described, but the present invention can be carried out in image forming apparatuses, in various fields, such as printers, various printing machines, copying machines, facsimile machines, and multi-function machines, by adding necessary devices, equipment and casing structures.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 270868/2013 filed Dec. 27, 2013, which is hereby incorporated by reference.

What is claimed is:

1. An image forming apparatus comprising:

an image bearing member;

an electrostatic image forming unit for forming an electrostatic image on said image bearing member;

a developing unit for developing the electrostatic image, formed on said image bearing member, into a toner image;

an intermediary transfer member for carrying and feeding the toner image primary-transferred thereon from said image bearing member at a primary transfer position;

a rotatable secondary transfer member for secondary-transferring the toner image from said intermediary transfer member onto a recording material at a secondary transfer position by feeding the recording material by rotation thereof while sandwiching the recording material between itself and said intermediary transfer member;

a constant voltage element electrically connected between said intermediary transfer member and a ground potential;

a voltage source for applying a voltage to said rotatable secondary transfer member to form a secondary transfer electric field at the secondary transfer position and for passing a current through said constant voltage element to form a primary transfer electric field at the primary transfer position, wherein said apparatus is operable in a lowering mode in which the secondary transfer electric field in a trailing end region of the recording material passing through the secondary transfer position with respect to a recording material feeding direction is made lower than the secondary transfer electric field in a region from a leading end to the trailing end region of the recording material; and a controller for setting a toner image distance between consecutively formed toner images in an operation in the lowering mode, wherein said controller sets the toner image distance so as to be longer than the toner image distance when the operation in the lowering mode is not performed to prevent a toner image from being primary-transferred in a period in which the secondary transfer electric field is lowered.

2. An image forming apparatus according to claim 1, wherein said intermediary transfer member is an intermediary transfer belt having at least two layers in which a resistance value of one layer toward said image bearing member is set so as to be higher than a resistance value of another layer.

3. An image forming apparatus according to claim 1, further comprising information inputting portion for inputting information on the recording material, wherein said controller executes the operation in the lowering mode on the basis of the information on the recording material inputted by said information inputting portion.

4. An image forming apparatus according to claim 1, further comprising an environmental sensor for detecting an ambience at a periphery of a main assembly of said image forming apparatus, wherein said controller executes the operation in the lowering mode on the basis of a detection result of said environmental sensor.

5. An image forming apparatus comprising:

an image bearing member;

an electrostatic image forming unit configured to form an electrostatic image on said image bearing member;

a developing unit configured to develop the electrostatic image formed on said image bearing member into a toner image;

an intermediary transfer member configured to carry and feed the toner image primary-transferred thereon from said image bearing member at a primary transfer position;

a rotatable secondary transfer member configured to secondary-transfer the toner image from said intermediary transfer member onto a recording material at a secondary transfer position by feeding the recording material by rotation thereof while sandwiching the recording material between itself and said intermediary transfer member;

a constant voltage element electrically connected between said intermediary transfer member and a ground potential, configured to maintain a predetermined voltage by passing of a current therethrough;

a voltage source configured to apply a voltage to said rotatable secondary transfer member to form a secondary transfer electric field at the secondary transfer position and configured to pass a current through said constant voltage element to maintain the predetermined voltage to form a primary transfer electric field at the primary transfer position; and an execution portion configured to execute an operation in a first mode in which image formation is executed subsequently to the recording material having a first basis weight and an operation in a second mode in which image formation is executed subsequently to the recording material having a second basis weight smaller than the first basis weight, wherein in the operation in the first mode, said execution portion sets the secondary transfer electric field in a trailing end region of the recording material passing through the secondary transfer position with respect to a recording material feeding direction so as to be smaller than the secondary transfer electric field in a central region of the recording material passing through the secondary transfer position, in the operation in the second mode, said execution portion sets the secondary transfer electric field in a trailing end region of the recording material passing through the secondary transfer position and the secondary transfer electric field in a central region of the recording material passing through the secondary transfer position so as to be the same, and said execution portion sets a toner image distance between consecutively formed toner images in the operation in the first mode so as to be longer a toner image distance in the operation in the second mode so that the toner image does not pass through the primary transfer position when said constant voltage element has a voltage less than the predetermined voltage in a period in which the secondary transfer electric field is set at a low value in the operation in the first mode.

6. An image forming apparatus according to claim 5, wherein said intermediary transfer member is an intermediary transfer belt having at least two layers in which a resistance value of one layer toward said image bearing member is set so as to be higher than a resistance value of another layer.

7. An image forming apparatus according to claim 5, further comprising information inputting portion configured to input information on the recording material, wherein said execution portion executes the first mode on the basis of the information on the recording material inputted by said information inputting portion.

8. An image forming apparatus according to claim 5, further comprising an environmental sensor configured to detect an ambience at a periphery of a main assembly of said image forming apparatus, wherein execution portion executes the first mode on the basis of a detection result of said environmental sensor.

9. An image forming apparatus comprising:

an image bearing member;

an electrostatic image forming unit configured to form an electrostatic image on said image bearing member;

a developing unit configured to develop the electrostatic image formed on said image bearing member into a toner image;

an intermediary transfer member configured to carry and feed the toner image primary-transferred thereon from said image bearing member at a primary transfer position;

a rotatable secondary transfer member configured to secondary-transfer the toner image from said intermediary transfer member onto a recording material at a secondary transfer position by feeding the recording material by rotation thereof while sandwiching the recording material between itself and said intermediary transfer member;

a constant voltage element electrically connected between said intermediary transfer member and a ground potential, and being configured to maintain a predetermined voltage by passing of a current therethrough;

a voltage source configured to apply a voltage to said rotatable secondary transfer member to form a secondary transfer electric field at the secondary transfer position and configured to pass a current through said constant voltage element to maintain the predetermined voltage to form a primary transfer electric field at the primary transfer position; and an execution portion configured to execute an operation in a thick mode in which image formation is executed subsequently to the recording material having a basis weight which is larger than a predetermined basis weight, wherein the operation in the thick mode, said execution portion sets a toner image distance between consecutively formed toner images in the operation in the thick mode so that the toner image does not pass through the primary transfer position when said constant voltage element has a voltage less than the predetermined voltage in a period in which the secondary transfer electric field is set at a low value.

10. An image forming apparatus according to claim 9, wherein said intermediary transfer member is an intermediary transfer belt having at least two layers in which a resistance value of one layer toward said image bearing member is set so as to be higher than a resistance value of another layer.

11. An image forming apparatus according to claim 9, further comprising information inputting portion configured to input information on the recording material, wherein said execution portion executes the thick mode on the basis of the information on the recording material inputted by said information inputting portion.

12. An image forming apparatus according to claim 9, further comprising an environmental sensor configured to detect an ambience at a periphery of a main assembly of said image forming apparatus, wherein execution portion executes the thick mode on the basis of a detection result of said environmental sensor.

* * * * *